US012635749B2

(12) United States Patent
Carlino et al.

(10) Patent No.: US 12,635,749 B2
(45) Date of Patent: May 26, 2026

(54) LOWER-BODY GARMENT WITH LEAK PROTECTION FEATURES

(71) Applicant: NIKE, Inc., Beaverton, OR (US)

(72) Inventors: Shannan C. Carlino, Portland, OR (US); Cara Jackson, Portland, OR (US); Iustinia Koshkarooff, Portland, OR (US); Raegen A. Stauffer, Portland, OR (US); Iris Lo, New Taipei City (TW)

(73) Assignee: NIKE, Inc., Beaverton, OR (US)

( * ) Notice: Subject to any disclaimer, the term of this patent is extended or adjusted under 35 U.S.C. 154(b) by 209 days.

(21) Appl. No.: 18/096,955

(22) Filed: Jan. 13, 2023

(65) Prior Publication Data

US 2023/0225437 A1 Jul. 20, 2023

Related U.S. Application Data

(60) Provisional application No. 63/299,644, filed on Jan. 14, 2022.

(51) Int. Cl.
*A41D 31/10* (2019.01)
*A41D 1/06* (2006.01)
(Continued)

(52) U.S. Cl.
CPC ..... *A41D 31/10* (2019.02); *A41D 1/06* (2013.01); *A41B 9/001* (2013.01); *A41B 9/004* (2013.01); *A41B 9/12* (2013.01); *A41D 1/088* (2013.01)

(58) Field of Classification Search
CPC ..... A41D 31/10; A41D 1/06; A41D 1/088; A41D 9/001; A41D 9/004; A41D 9/12; A41B 9/001; A41B 9/004; A41B 9/12
(Continued)

(56) References Cited

U.S. PATENT DOCUMENTS 4,355,425 A 10/1982 Jones et al.
4,395,336 A 7/1983 Eng
(Continued)

FOREIGN PATENT DOCUMENTS

AU 2017412281 A1 11/2019
CA 2309910 C 7/2004
(Continued)

OTHER PUBLICATIONS

Meticulously Designed and Expertly Constructed Leak Proof Undies, shopproof.com, Available online at <https://shopproof.com/pages/how-it-works, Retrieved on Jan. 27, 2023, 3 pages.
(Continued)

*Primary Examiner* — Khaled Annis
*Assistant Examiner* — Dakota Marin
(74) *Attorney, Agent, or Firm* — Shook, Hardy & Bacon L.L.P.

(57) ABSTRACT

A lower-body garment that has built-in leak protection. The built-in leak protection can be achieved through an integral gusset or an internal assembly that is positioned interior to an exterior layer that forms the lower-body garment. The internal assembly can include a front torso portion, a back torso portion, and a crotch portion. The crotch portion can include a spacer fabric layer configured to be positioned adjacent to a wearer's body surface, and a moisture-barrier layer secured to the spacer fabric layer and configured to be face outward.

28 Claims, 12 Drawing Sheets

(51) Int. Cl.

| | |
|---|---|
| *A41B 9/00* | (2006.01) |
| *A41B 9/12* | (2006.01) |
| *A41D 1/08* | (2018.01) |

(58) Field of Classification Search
USPC ..... 2/79
See application file for complete search history.

(56) References Cited

U.S. PATENT DOCUMENTS

| | | | | |
|---|---|---|---|---|
| 4,813,950 | A | 3/1989 | Branch | |
| 5,098,419 | A | 3/1992 | Gold | |
| 5,514,459 | A | 5/1996 | Blauer et al. | |
| 6,248,097 | B1 | 6/2001 | Beitz et al. | |
| 6,539,555 | B2 * | 4/2003 | Suga | A61F 13/72 2/400 |
| 7,024,892 | B2 | 4/2006 | Blakely | |
| 8,959,959 | B1 * | 2/2015 | Podhajny | A43B 23/042 36/47 |
| 9,078,792 | B2 | 7/2015 | Ruiz | |
| 10,441,480 | B2 | 10/2019 | Griffiths | |
| 10,555,841 | B2 | 2/2020 | Png et al. | |
| 10,966,874 | B2 | 4/2021 | Lavon et al. | |
| 2003/0033656 | A1 * | 2/2003 | Jaeger | A41D 27/28 2/93 |
| 2006/0070163 | A1 | 4/2006 | Beck et al. | |
| 2008/0276352 | A1 | 11/2008 | Strange et al. | |
| 2010/0175170 | A1 * | 7/2010 | Dye | A41B 9/004 604/367 |
| 2010/0242149 | A1 * | 9/2010 | Mickle | A41D 13/002 2/243.1 |
| 2013/0061366 | A1 * | 3/2013 | Pezzimenti | A41D 1/04 2/69 |
| 2014/0025027 | A1 | 1/2014 | Png et al. | |
| 2014/0039432 | A1 | 2/2014 | Dunbar et al. | |
| 2016/0165959 | A1 * | 6/2016 | Hayes | A41B 9/04 2/67 |
| 2016/0279894 | A1 * | 9/2016 | Tsai | B32B 5/026 |
| 2017/0127731 | A1 * | 5/2017 | Flower | A41C 3/0057 |
| 2017/0290374 | A1 | 10/2017 | Biodrowski et al. | |
| 2018/0022063 | A1 * | 1/2018 | Berrang | B32B 27/40 442/224 |
| 2019/0209394 | A1 | 7/2019 | Lässig | |
| 2021/0290447 | A1 | 9/2021 | Sepello et al. | |
| 2022/0339904 | A1 * | 10/2022 | Amin | A41D 31/10 |

FOREIGN PATENT DOCUMENTS

| | | | |
|---|---|---|---|
| CN | 103260571 | A | 8/2013 |
| CN | 104173140 | B | 4/2017 |
| CN | 107049607 | A | 8/2017 |
| CN | 109438746 | A | 3/2019 |
| CN | 111040080 | A | 4/2020 |
| EP | 2412353 | A3 | 4/2015 |
| JP | 60-052556 | A | 3/1985 |
| JP | 61-168103 | U | 8/1986 |
| JP | 08-056974 | A | 3/1996 |
| JP | 10-179624 | A | 7/1998 |
| JP | 2001-271204 | A | 10/2001 |
| JP | 2005-137617 | A | 6/2005 |
| JP | 2010-233602 | A | 10/2010 |
| KR | 10-0694187 | B1 | 3/2007 |
| TW | 362009 | B | 6/1999 |
| TW | 201408269 | A | 3/2014 |

OTHER PUBLICATIONS

Period Underwear, Getrael.com, Available online at <https://www.getrael.com/collections/underwear>, Retrieved on Jan. 27, 2023, 1 page.

Period Underwear, Knix.com, Available online at <https://knix.com/collections/leakproof>, Retrieved on Jan. 27, 2023, 5 pages.

Periods. Incontinence. Sweat. Pregnancy & Postpartum., Modibodi.com, Available online at <https://us.modibodi.com/pages/howitworks/?_ics=1675851689347&irclickid=~73ULQPFvmd~12VQORSY4VLMGCzBCIMFLHLKJKAByrkjhd61ZUQMD>, Retrieved on Jan. 27, 2023, 3 pages.

International Search Report and Written Opinion received for PCT Patent Application No. PCT/US2023/010841, mailed on Mar. 17, 2023, 9 pages.

Office Action received for European Application No. 23705133.9, mailed on Apr. 16, 2025, 4 pages.

Extended European Search Report received for European Patent Application No. 25176757.0, mailed on Jul. 15, 2025, 7 pages.

Office Action received for European Application No. 23705133.9, mailed on Sep. 8, 2025, 3 pages.

* cited by examiner

LOWER-BODY GARMENT WITH LEAK PROTECTION FEATURES

TECHNICAL FIELD

Aspects herein are directed to a lower-body garment that includes leak protection features.

BACKGROUND

Women who exercise during their menstrual cycle may wear disposable menstrual pads to provide leak protection. Similarly, women that have incontinence issues may also feel the need to wear disposable pads for leak protection. In some instances, garments can have built-in leak protection

SUMMARY

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A lower-body garment comprising: an external layer forming a torso portion, the torso portion having a waist opening, a first leg opening, and a second leg opening; and an internal assembly positioned internal to the external layer, the internal assembly comprising: a front torso portion, a back torso portion, at least one of the front torso portion or the back torso portion being coupled to the external layer, and a crotch panel between the first leg opening and the second leg opening, the crotch panel comprising a spacer fabric layer and a moisture-barrier layer secured to the spacer fabric layer.

Clause 2. The lower-body garment of clause 1, wherein the front torso portion of the internal assembly includes a front upper edge secured to the external layer, and wherein the back torso portion of the internal assembly includes a back upper edge secured to the external layer.

Clause 3. The lower-body garment of clause 1 or clause 2, wherein: the front torso portion has a first side edge that is located on a first side of the lower-body garment and that includes a lower end positioned a first distance below the waist opening, and the back torso portion has a first side edge that is located on the first side of the lower-body garment and that includes a lower end positioned a second distance below the waist opening, the second distance being greater than the first distance.

Clause 4. The lower-body garment of any of clauses 1 through 3, wherein the internal assembly further comprises a crotch area that continuously extends between the front torso portion and the back torso portion and that includes an inner-facing surface facing towards the crotch panel.

Clause 5. The lower-body garment of any of clauses 1 through 4, wherein: the front torso portion has a first side edge located on a first side of the lower-body garment, the back torso portion has a first side edge that is located on the first side of the lower-body garment, and the first side edge of the front torso panel is spaced apart from the first side edge of the back torso panel.

Clause 6. The lower-body garment of clause 5, wherein the crotch panel joins the front torso portion to the back torso portion.

Clause 7. The lower-body garment of any of clauses 1 through 6, wherein the front torso portion and the back torso portion comprise a durable water repellant (DWR) treatment.

Clause 8. The lower-body garment of any of clauses 1 through 8, wherein the internal assembly further comprises a crotch area that continuously extends between the front torso portion and the back torso portion and that wraps around side edges of the crotch panel.

Clause 9. The lower-body garment of any of clauses 1 through 8, wherein the spacer fabric layer comprises an innermost surface of the lower-body garment and comprises a first layer, a second layer, and a plurality of tie yarns that interconnect the first layer and the second layer, the plurality of tie yarns comprising elastic yarns.

Clause 10. The lower-body garment of any of clauses 1 through 9, wherein the moisture-barrier layer comprises a thermoplastic polymer material.

Clause 11. The lower-body garment of any of clauses 1 through 10, wherein: the front torso portion has a first side edge located on a first side of the lower-body garment, the back torso portion has a first side edge that is located on the first side of the lower-body garment, and the first side edge of the front torso portion is affixed to the first side edge of the back torso portion.

Clause 12. A garment comprising: a torso portion comprising a first leg opening and a second leg opening; and a crotch portion between the first leg opening and the second leg opening, wherein the crotch portion comprises a composite textile, which comprises a spacer fabric and a moisture-barrier layer; and wherein the moisture-barrier layer comprises a thermoplastic polymer film.

Clause 13. The garment of clause 12, wherein the crotch portion further comprises a textile layer treated with a durable water repellant (DWR) solution and at least a portion of the moisture-barrier layer is layered between the spacer knit textile and the textile layer.

Clause 14. The garment of clause 13, wherein the spacer knit textile comprises a side edge proximate the first leg opening; and wherein the textile layer wraps over the side edge to form a hem.

Clause 15. The garment of clause 13, wherein the spacer knit textile comprises a front edge coupled to a front of the torso portion; and wherein the garment further comprises a DWR-treated bonding strip that at least partially overlaps the front edge and the front of the torso portion.

Clause 16. The garment of clause 15, wherein the DWR-treated bonding strip comprises a textile layer and an adhesive layer, and wherein the textile layer comprises a DWR solution.

Clause 17. The garment of any of clauses 12 through 16, wherein the spacer fabric comprises a spacer knit textile comprising a first knit layer, a second knit layer, and tie yarns connecting the first knit layer to the second knit layer.

Clause 18. The garment of clause 17, wherein the tie yarns comprise a first yarn having a first denier and a second yarn having a second denier, which is different size from the first denier.

Clause 19. The garment of any of clauses 12 through 18, wherein: the garment comprises an internal assembly and an external layer; the torso portion and the crotch portion comprise at least a portion of the internal assembly; and the torso portion comprises a front upper edge and a back upper edge, at least one of the front upper edge and the back upper edge being affix to the external layer.

Clause 20. The garment of any of clauses 12 through 19, wherein garment comprises an undergarment configured to be selectively worn underneath a variety of external lower-body garments.

Clause 21. A method of manufacturing a lower-body garment, the method comprising: forming a torso portion from an external layer of material, the torso portion having a waist opening, a first leg opening, and a second leg opening; positioning an internal assembly interior to the external layer of material, the internal assembly comprising: a front torso panel, a back torso panel, and a crotch panel between the first leg opening and the second leg opening and joining the front torso panel to the back torso panel, the crotch panel comprising a spacer fabric layer forming, in part, an innermost-facing surface of the lower-body garment, and a moisture-barrier layer laminated to the spacer fabric layer; and securing the internal assembly to the external layer of material at a plurality of securement areas.

Clause 22. A method comprising: affixing, as part of an internal assembly for a lower-body garment, a crotch gusset to a front torso portion and to a back torso portion, the crotch gusset comprising a spacer fabric textile and a moisture-barrier layer; affixing the front torso portion to an exterior layer of the lower-body garment, the exterior layer comprising a torso portion having a waist opening, a first leg opening, and a second leg opening; and affixing the rear torso portion to the exterior layer of the lower-body garment Clause 23. The method of clause 22, wherein: the front torso portion is continuous with the back torso portion, based on a crotch area extending between the front torso portion and the back torso portion; and affixing the crotch gusset to the front torso portion and to the back torso portion comprises wrapping an edge of the crotch area around a side edge of the spacer fabric textile and affixing the edge of the crotch area to the spacer fabric textile.

Clause 24. The method of clause 22 or clause 23, wherein: the front torso portion comprises a side edge and affixing the front torso portion to the external layer comprises affixing the side edge of the front torso portion to a side of the torso portion; and the back torso portion comprises a side edge and affixing the back torso portion to the external layer comprises affixing the side edge of the back torso portion to the side of the torso portion and spaced apart from the side edge of the front torso portion.

Clause 25. The method of any of clauses 22 through 24 further comprising, laminating the spacer fabric textile and the moisture-barrier layer.

Clause 26. A lower-body garment comprising: a composite laminate associated with a crotch area of the lower-body garment; the composite laminate comprising: a spacer fabric layer, and a moisture-barrier layer secured to the spacer fabric layer.

Clause 27. The lower-body garment of clause 26 further comprising, a textile layer, wherein the moisture-barrier layer is layered between the textile layer and the spacer fabric layer.

Clause 28. The lower-body garment of clause 27, wherein the textile layer comprises a durable water repellant (DWR) treatment.

Clause 29. The lower-body garment of clause 27 or clause 28, wherein the spacer fabric layer, the moisture-barrier layer, and the textile layer comprise an integral crotch gusset associated with the lower-body garment.

Clause 30. The lower-body garment of any of clauses 26 through clause 29, wherein the lower-body garment comprises a first leg portion and a second leg portion.

Clause 31. The lower-body garment of any of clauses 27 through 30, wherein the spacer fabric layer, the moisture-barrier layer, and the textile layer comprise a crotch area of a built-in undergarment that is affixed in an interior of the lower-body garment.

Clause 32. The lower-body garment of any of clauses 27 through 31, wherein: the spacer fabric layer comprises a first edge: the moisture-barrier layer comprises a second edge; and the textile layer comprises a third edge that wraps around the first edge and the second edge.

Clause 33. The lower-body garment of any of clauses 27 through 32, wherein the textile layer is laminated together with the spacer fabric layer and the moisture-barrier layer.

Clause 34. The lower-body garment of any of clauses 26 through 33, wherein the composite laminate comprises a second spacer fabric layer that is layered between the spacer fabric layer and the moisture-barrier layer.

Clause 35. The lower-body garment of any of clauses 26 through 34, wherein the composite laminate comprises natural-fiber layer that is layered between the spacer fabric layer and the moisture-barrier layer.

Clause 36. The lower-body garment of any of clauses 26 through 35, wherein: the spacer fabric layer includes a first knit layer, a second knit layer, and tie yarns connecting the first knit layer to the second knit layer; and the tie yarns comprise a first yarn having a first denier and a second yarn having a second denier, which is different from the first denier.

BRIEF DESCRIPTION OF THE DRAWINGS

Examples of aspects herein are described in detail below with reference to the attached drawing figures, wherein.

DETAILED DESCRIPTION

Figures 1, 2, 3:
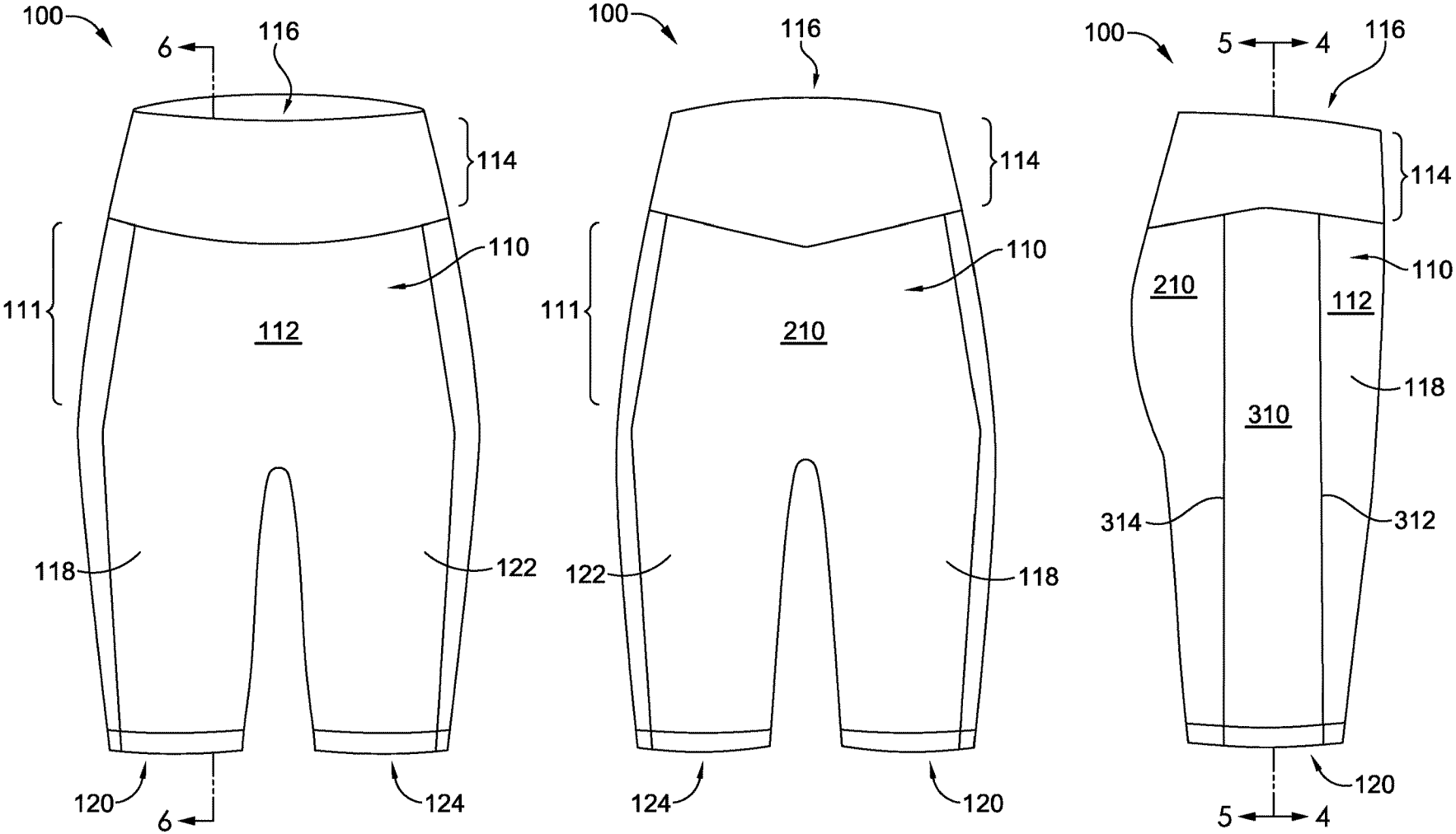
FIG. 1 illustrates a front view of an exterior of a first example lower-body garment in accordance with aspects herein.
FIG. 2 illustrates a back view of the exterior of the first example lower-body garment of FIG. 1 in accordance with aspects herein.
FIG. 3 illustrates a side view of the exterior of the first example lower-body garment of FIG. 1 in accordance with aspects herein where an opposite side view would be the same.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Women who exercise during their menstrual cycle may wear disposable menstrual pads to provide leak protection. Similarly, women that have incontinence issues may also feel the need to wear disposable pads for leak protection. These pads are often secured to garments through use of a releasable adhesive and are disposed of after use. The extra pads not only create unsightly panty lines but may become displaced during activity which negates any protection the pad may provide. Some garments that have built-in leak protection are generally in the form of underwear that is worn as a separate article under athletic clothing, and these garments can be bulky, uncomfortable, and create unsightly (e.g., exaggerated) panty lines. In addition, they can require an extra apparel layer, which can create additional cost and affect overall breathability, moisture management, thermal management (e.g., associated with heating and/or cooling), and the like.

At least some examples of the present disclosure are related to a leak-protection composite structure, textile, or laminate that can be incorporated into various types of garments. In some examples, the composite textile can include multiple layers of textiles that cooperate with one another to absorb moisture on the inside of a garment and reduce the likelihood of the moisture being viewable (e.g., showing through) on the outside of the garment. For example, the leak-protection composite textile can include a spacer fabric combined with a moisture-barrier layer, with the spacer fabric being configured to face towards the wearer (e.g., on the inner face of the garment). In examples, the leak-protection composite textile can be relatively thin, while still operating to absorb moisture. The leak-protection composite textile can be integrated into various garments and into various locations within a garment. For example, the leak-protection composite can be integrated into a crotch area of a lower-body garment (e.g., to help absorb and hide menstrual blood, urine, sweat, etc.).

At least some aspects herein are directed to a lower-body garment (e.g., a form-fitting athletic short or athletic capri or pant) that has built-in leak protection where the lower-body garment is configured for repeated use and can be washed without impacting the leak protection features of the garment. The built-in leak protection is achieved through use of an internal assembly that is positioned interior to an exterior layer that forms the lower-body garment. The internal assembly includes a front torso panel, a back torso panel, and a crotch panel that extends between the front torso panel and the back torso panel and is positioned between leg openings of the lower-body garment (i.e., in a crotch area of the lower-body garment). In example aspects, the crotch panel includes a spacer fabric (e.g., spacer knit textile, spacer mesh textile, or other type of spacer fabric) configured to be positioned adjacent to a wearer's body surface, and a moisture-barrier layer secured to the spacer fabric and configured to be face outward (i.e., away from the wearer's body surface). Bodily fluids generated by the wearer such as menstrual blood and/or urine may be stored in the space between the first and second layers of the spacer fabric. The moisture-barrier layer prevents any bodily fluids that escape the spacer fabric from leaking through to the exterior layer. The different portions of the internal assembly are patterned and secured to the external layer in such a way that panty lines are minimized, which is important considering that the lower-body garment is form fitting. The result is an athletic garment with a clean aesthetic and aerodynamic profile that can be repeatedly worn by women during menstruation or as needed.

The term "lower-body garment" as used herein means a garment configured to be worn on the lower-torso of a wearer. The lower-body garment may be in the form of an underwear-type garment with no leg portions (e.g., a brief-style undergarment), a boxer brief, a boy-short style undergarment, a short, a capri, a legging, and the like. When describing the lower-body garment as "form fitting," it is meant that the lower-body garment closely conforms to the underlying morphology of the wearer. This is usually achieved through use of elastic yarns that have stretch and recovery properties.

Positional terms used when describing the lower-body garment are with respect to the lower-body garment being worn as intended by a wearer standing upright. In aspects herein, the lower-body garment is intended to be worn such that the spacer mesh layer in the crotch panel is in contact with a wearer's body surface such that the garment cannot be worn inside-out because the intended purpose of the garment would not be achieved (e.g., to provide leak protection). The term "front torso" as used herein refers to portions of the lower-body garment configured to be positioned adjacent to a lower front torso area of a wearer, and the term "back torso" as used herein refers to portions of the lower-body garment configured to be positioned adjacent to a back lower torso area of the wearer. The term "side" as used herein refers to portions of the lower-body garment configured to be positioned adjacent to a side torso area and/or side leg area of the wearer. The term "crotch" as used herein refers to portions of the lower-body garment configured to be positioned adjacent to a crotch area of the wearer as that term is generally recognized.

The terms "upper" and "lower" as used herein are relative terms such that, for example, an "upper edge" is located closer to a waist opening of the lower-body garment compared to a "lower edge," and a "lower edge" is located closer to a leg opening of the lower-body garment compared to an "upper edge."

The terms "external" and "internal" as used herein are relative terms such that a layer that is external is positioned external to one or more internal layers, and a layer that is internal is positioned internal to one or more external layers. In example aspects, the external layer is exposed to an external environment, and the internal layer is not exposed to the external environment. The term "innermost-facing surface" when used with respect to the lower-body garment means a layer that is positioned closest to a body surface of a wearer compared to other layers of the lower-body garment. The term "outermost-facing surface" when used with respect to the lower-body garment means a layer that is positioned closest to the external environment with respect to other layers of the lower-body garment.

The term "spacer fabric" as used herein is meant to encompass both warp knit and weft knit spacer knit textiles. Spacer fabrics can be generally formed by utilizing at least one tie yarn to interknit first and second layers of the textile. More specifically, each of the first layer and the second layer may be knit separately, and the tie yarn(s) is used to connect the first layer and the second layer. For instance, the tie yarns may have "loop" portions that extend into each of the first layer and the second layer where the loop portions are interlooped with yarns in the first layer and the second layer to connect the two layers. In example aspects, the tie yarns are oriented generally orthogonal to the surface planes of the first and second layers and act to space apart the first and second layers. The result is that a space is formed between the first and second layers that may be used to retain or store fluids such as menstrual fluids and/or urine. Because the first layer and the second layer are knit separately, each of the first layer, the second layer, and the tie yarns may be knit with different yarns and/or different yarn types. For example, the tie yarns can include different compositional materials and/or different sizes (e.g., different lengths between knit layers, different diameters, different deniers, etc.).

The term "moisture-barrier layer" as used herein generally refers to a layer that is impervious or substantially impervious to moisture penetration especially moisture in the form of a liquid. The layer may be in the form of a waterproof film such as, for example, a thermoplastic polymer (e.g., thermoplastic elastomer film) although other types of films are contemplated herein.

In example aspects, the moisture-barrier layer may be secured to the spacer fabric layer through a lamination process (e.g., by a dot glue lamination process) such that the spacer fabric layer and the moisture-barrier layer form a composite, unitary structure. In at least some examples, a dot lamination process can improve the flexibility of the laminate structure, as compared an alternative lamination process in which the glue or adhesive is more widely distributed.

In at least some examples, the moisture-barrier layer can allow at least some vapor to pass through, and also be substantially impervious to moisture penetration (e.g., liquid moisture penetration), such that it significantly impedes moisture from penetrating entirely through the moisture-barrier layer (e.g., entirely through the film from one side through the other side).

As used herein, the term "about" means within ±10% of a given value.

FIGS. 1-3 respectively illustrate a front view, a back view, and a side view of an exterior of a first example lower-body garment 100 where the exterior would be viewable by an observer viewing the lower-body garment 100 as worn by a wearer. The lower-body garment 100 is shown in the form of a short but aspects herein contemplate that the lower-body garment 100 may be in the form of an "underwear-type" garment (which may also be known as a boy short), a capri, a legging, a unitard, and the like.

In example aspects, the exterior of the lower-body garment 100 is formed from an external layer 110 such that the external layer 110 forms a torso portion 111 including a front torso portion 112 (seen in FIG. 1) and a back torso portion 210 (seen in FIG. 2) that together define, at least in part, a waist opening 116. In example aspects, the lower-body garment 100 may optionally include a waistband 114 that further defines the waist opening 116. The external layer 110 also optionally forms a first leg portion 118 having a first leg opening 120 and a second leg portion 122 having a second leg opening 124. In example aspects where the lower-body garment 100 does not include the first and second leg portions 118 and 122, the first and second leg openings 120 and 124 would be located on the torso portion 111 (similar to an underwear-type garment).

In the side view of the lower-body garment 100 depicted in FIG. 3, the external layer 110 further includes a side panel 310 that extends generally vertically from a lower edge of the waistband 114 to the first leg opening 120. The side panel 310 may be formed from the same material as the external layer 110. An opposite side view of the lower-body garment 100 would also include a side panel that extends from the lower edge of the waistband 114 to the second leg opening 124. As such, the description of the side panel 310 is also applicable to the side panel located on the opposite side. The side panel 310 may be a separate panel that is secured or joined to portions of the external layer 110 forming the front torso portion 112, the first leg portion 118, and the back torso portion 210 at a first seam 312 and a second seam 314. The first and second seams 312 and 314 may be formed using affixing technologies such as stitching, bonding, adhesives, welding, and the like.

In example aspects, the external layer 110 comprises, for example, a knit or woven textile having elastic yarns. As used herein, the term "elastic yarn" means a yarn having stretch and recovery properties such that the elastic yarn may be stretched up to about 100% to 200% of its resting length and substantially return to its resting length when the stretching force is removed. In examples including elastic yarns, the external layer 110 can closely conforms to the underlying morphology of a wearer as shown in FIGS. 1-3 (i.e., the external layer 110 is form fitting). In at least some examples, the external layer 110 can be more loose fitting (e.g., more loose fitting than a tight-style lower-body garment). In some examples, the external layer can include yarns with less elasticity (e.g., that stretch less than 100% of a resting length before returning to the resting length) or yarns that are considered non-elastic (e.g., as that term is understood in the industry). The lower-body garment 100 includes an example panel construction (e.g., example panel sizes, shapes, etc.) that forms the body of the lower-body garment 100, and in other examples, a lower-body garment can include a different panel construction (e.g., panels with different size, shapes, positions, etc.).

Figure 6:
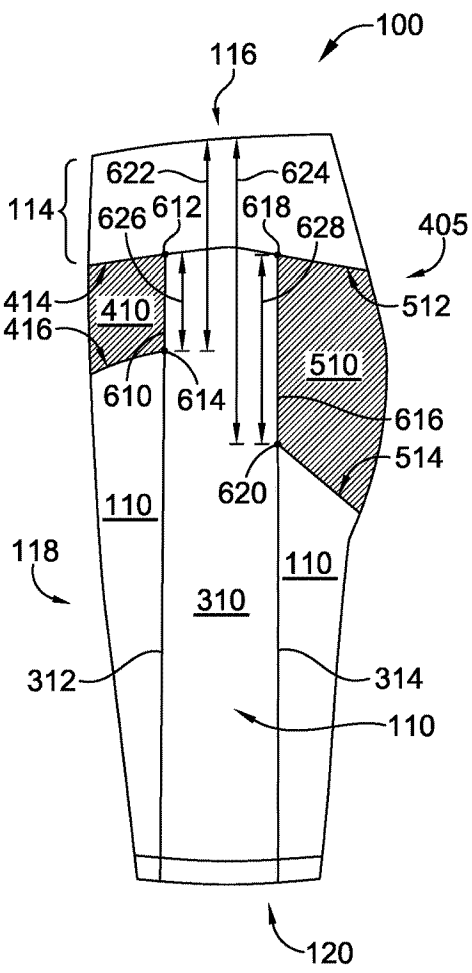
FIG. 6 illustrates a side view of the interior of the first example lower-body garment of FIG. 1 in accordance with aspects herein where an opposite side view would be the same.
Figure 5:
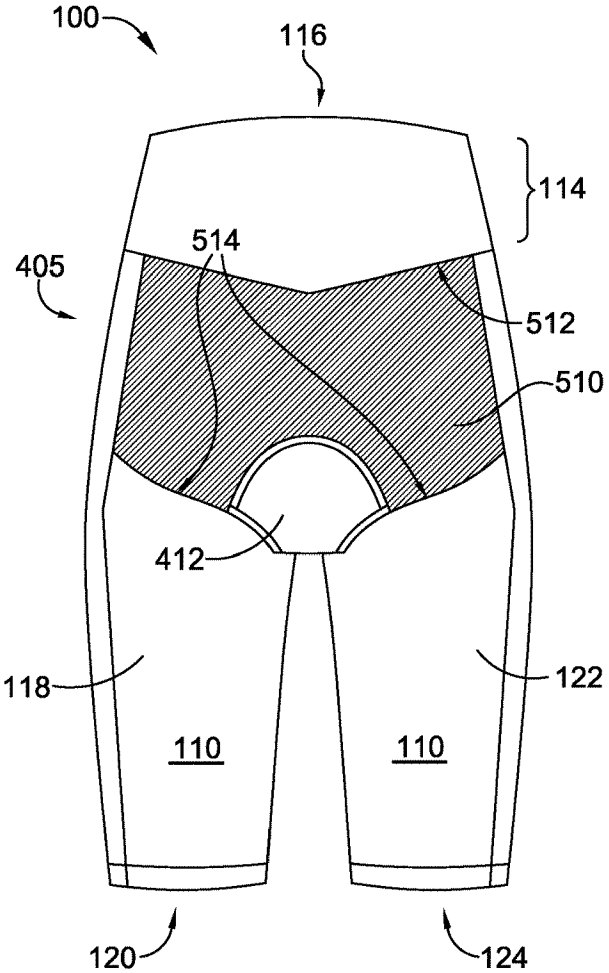
FIG. 5 illustrates a back view of the interior of the first example lower-body garment of FIG. 1 in accordance with aspects herein.
Figure 4:
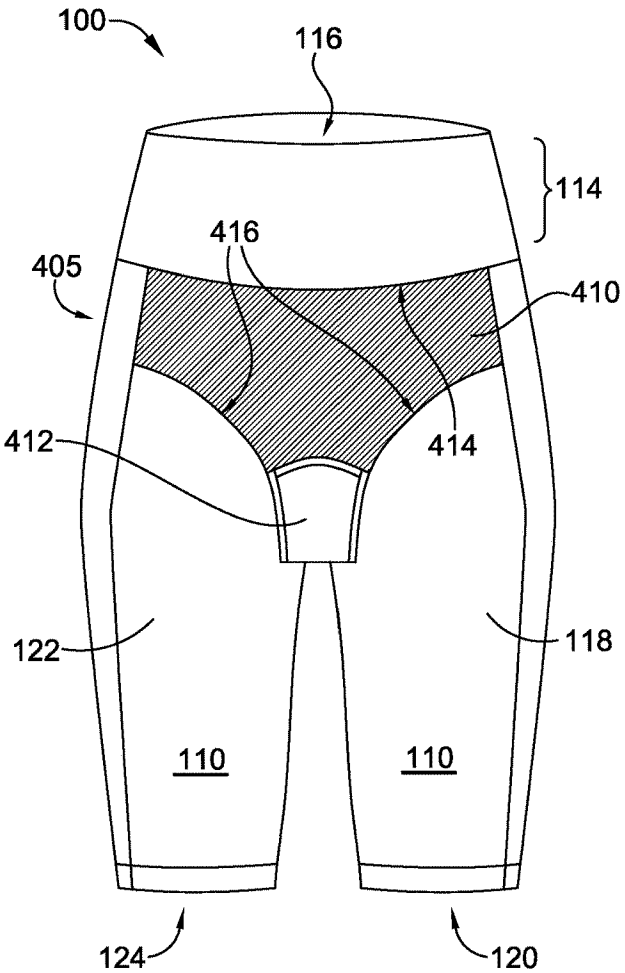
FIG. 4 illustrates a front view of an interior of the first example lower-body garment of FIG. 1 in accordance with aspects herein.

FIGS. 4-6 respectively illustrate, from a perspective inside the lower-body garment 100, front, back, and side views of the lower-body garment 100 based on the respective reference positions identified in FIGS. 1 and 3 (e.g., where the interior would not necessarily be viewable by an observer viewing the lower-body garment 100 as worn by a wearer). In example aspects, the lower-body garment 100 includes an internal assembly referenced generally by the numeral 405. With respect to FIG. 4, the internal assembly 405 includes a front torso portion 410 (indicated with hatching) configured to cover a front lower torso of a wearer. In example aspects, and as shown, the front torso portion 410 does not include leg portions.

In some examples, the front torso portion 410 can include a front part of a larger brief-type article that is coupled inside the lower-body garment 100. In examples, the front torso portion 410 can continuously extend through a crotch area of the brief-type article and transition to a back torso portion (e.g., a back torso portion 510 in FIG. 5), and an example similar to this is also depicted with respect to FIG. 18. In some examples, the front torso portion 410 can include a panel that attaches to a crotch panel 412 (e.g., the front torso portion 410 can terminate at the crotch panel 412 and does not extend through the crotch area).

The front torso portion 410 includes a front upper edge 414 and front lower edges 416. In example aspects, the front upper edge 414 is permanently secured to the external layer 110 by way of, for example, stitching, bonding, and the like. Further, in example aspects, the front upper edge 414 is permanently secured adjacent to (e.g., from about 0.1 mm to about 8 cm) the waist opening 116. When the lower-body garment 100 includes a waistband such as the waistband 114, the front upper edge 414 is permanently secured to a lower edge of the waistband 114. In example aspects, the front lower edges 416 are free, terminal edges that are not secured or affixed to the external layer 110. In further example aspects, the front lower edges 416 may include raw, cut edges of the material used to form the front torso portion 410. Stated differently, the front lower edges 416 may be unhemmed and may not include any trim pieces to provide a clean aesthetic and minimize the appearance of panty lines on the lower-body garment 100. FIG. 4 further depicts a portion of the crotch panel 412, which will be described in additional detail below.

With respect to FIG. 5, the internal assembly 405 further includes a back torso portion 510 (shown with hatching) configured to cover a back lower torso of a wearer. In some examples, the back torso portion 510 can include a back part of a larger brief-type article that is coupled inside the lower-body garment 100. In examples, the back torso portion 510 can continuously extend through the crotch area of the brief-type article and transition to the front torso portion 410, and an example similar to this is also depicted with respect to FIG. 18. In some examples, the back torso portion 510 can include a panel that attaches to the crotch panel 412 (e.g., the back torso portion 510 terminates at the crotch panel 412 and does not extend through the crotch area).

In example aspects, and as shown, the back torso portion 510 does not include leg portions. The back torso portion 510 includes a back upper edge 512 and back lower edges 514. In example aspects, the back upper edge 512 is permanently secured to the external layer 110 by way of, for example, stitching, bonding, and the like. Further, in example aspects, the back upper edge 512 is permanently secured adjacent to (e.g., from about 0.1 mm to about 8 cm) the waist opening 116. When the lower-body garment 100 includes a waistband such as the waistband 114, the back upper edge 512 is permanently secured to a lower edge of the waistband 114. In example aspects, the back lower edges 514 are free, terminal edges that are not secured or affixed to the external layer 110. In further example aspects, the back lower edges 514 may include raw, cut edges of the material used to form the back torso portion 510. Stated differently, the back lower edges 514 may be unhemmed and may not include any trim pieces to provide a clean aesthetic and minimize the appearance of panty lines on the lower-body garment 100. FIG. 5 further depicts a portion of the crotch panel 412.

In example aspects, the front torso portion 410 and the back torso portion 510 may both be formed of a lightweight knit material having elastic yarns. For example, the material forming the front torso portion 410 and the back torso portion 510 may have a weight from about 100 grams per square meter (gsm) to about 150 gsm, from about 120 gsm to about 140 gsm, or about 125 gsm. The lightweight features of the material may be achieved by using a single knit construction such as a single knit plain tricot. In example aspects, the material may include both polyester yarns and elastic yarns to achieve a desired degree of stretch and recovery while still providing a soft feel and good moisture management features. For example, the material may include about 60% polyester, including recycled polyester, and about 40% elastane.

In at least some examples, the front torso portion 410 and the back torso portion 510 can include moisture-repellant properties. For example, the textile forming the front torso portion 410 and the back torso portion 510 can include a durable water repellant (DWR) treatment. In some examples, the DWR is applied to one or both surfaces of the textile (e.g., the inner facing surface and/or the outer facing surface).

In some examples, the textile forming the front torso portion 410 and the back torso portion 510 treated with DWR during padding and then heat set. In some instances, the textile can be dipped in a DWR solution, which can in turn be incorporated throughout the textile. In some examples, the DWR is integrated with yarn(s) constructing the front torso portion 410 and the back torso portion 510.

FIG. 6 depicts the side view of the lower-body garment 100 including the side panel 310 formed from the external layer 110. As depicted, the front torso portion 410 includes a first side edge 610 that has an upper end 612 and a lower end 614. In example aspects, the first side edge 610 is secured along its length 626 to the side panel 310 of the external layer 110 at the first seam 312. In example aspects, the lower end 614 of the first side edge 610 is positioned a first distance 622 below the waist opening 116.

The back torso portion 510 further includes a first side edge 616 that has an upper end 618 and a lower end 620. In example aspects, the first side edge 616 is secured along its length 628 to the side panel 310 at the second seam 314. Additionally, the lower end 620 of the first side edge 616 is positioned a second distance 624 below the waist opening 116, where the second distance 624 is greater than the first distance 622. To describe this differently, the length 626 of the first side edge 610 of the front torso portion 410 is less than the length 628 of the first side edge 616 of the back torso portion 510. As depicted in FIG. 6, the first side edge 610 of the front torso portion 410 is spaced apart from the first side edge 616 of the back torso portion 510 by the side panel 310 such that the first side edge 610 is unaffixed from or is not directly secured to the first side edge 616. The same configuration is present on the second opposite side of the lower-body garment 100.

The configuration shown, for example, in FIG. 6 provides a number of different advantages. For example, in a traditional undergarment having a front torso panel and a back torso panel, the respective side edges include equal lengths such that they can be joined or affixed together at the sides of the undergarment without excess material. This can restrain how the front and back panels can be patterned. By decoupling the front torso portion 410 from the back torso portion 510 at the respective first side edges 610 and 616, the panels 410 and 510 may be patterned in such a way to provide functional benefits to a wearer when the lower-body garment 100 is worn. For example, the front lower edges 416 may be positioned significantly higher than the back lower edges 514 to provide a generally unrestricted range of motion when the wearer raises their leg in a forward direction. Stated differently, the front lower edge 416 is generally positioned above a hip flexion area. This is achieved, at least in part, by positioning the lower end 614 of the first side edge 610 of the front torso portion 410 closer to the waist opening 116 than the lower end 620 of the first side edge 616 of the back torso portion 510. This configuration also minimizes panty lines. The back lower edges 514 may be positioned significantly lower than the front lower edges 416 to provide to provide full coverage of the wearer's buttocks. Stated differently, the back lower edges 514 may be positioned below the gluteal fold. This is achieved, at least in part, by positioning the lower end 620 of the first side edge 616 of the back torso portion 510 farther away from the waist opening 116 compared to the lower end 614 of the first side edge 610 of the front torso portion 410. This configuration also minimizes panty lines. FIGS. 4-6 depict one example in which the respective side edges of the front and back portions are spaced apart and not directly connected (e.g., along a side seam) to one another. In at least some examples, the respective side edges of the front and back torso portions can be joined along the sides edges.

Figure 7:
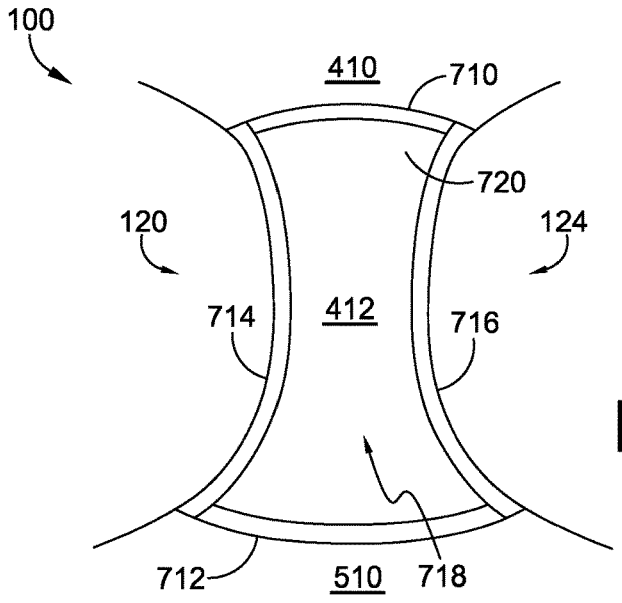
FIG. 7 illustrates a bottom-up view of a crotch panel from the interior of the first example lower-body garment of FIG. 1 in accordance with aspects herein.

As described, the internal assembly 405 further includes the crotch panel 412 which is shown in FIGS. 4 and 5 and which is further depicted in FIG. 7. The crotch panel 412 is located between the first leg opening 120 and the second leg opening 124. In some examples, the crotch panel 412 extends between the front torso portion 410 and the back torso portion 510 thereby joining the front torso portion 410 to the back torso portion 510. In some examples the front torso portion 410 and the back torso portion 510 are connected by a crotch area portion (e.g., a continuous panel material), and the crotch panel 412 is coupled to the crotch portion.

The crotch panel 412 is sized and positioned to cover a crotch area of a wearer and particularly a female wearer. With respect to FIG. 7, the crotch panel 412 includes a front edge 710 joined near the front torso portion 410, and a back edge 712 joined near the back torso portion 510. In examples, the front edge 710 and the back edge 712 are not affixed to the external layer 110 to allow some relative movement of the crotch panel 412 with respect to the external layer 110. The crotch panel 412 further includes a first side edge 714 and an opposite second side edge 716. In example aspects, the first side edge 714 and the second side edge 716 are unaffixed from or not attached to the external layer 110 which also facilitates some relative movement of the crotch panel 412 with respect to the external layer 110. The size and shape of the crotch panel 412 may be configured to minimize the surface area of the crotch panel 412 while still providing an adequate coverage surface area to capture, for example, menstrual blood flow and/or urine. In some examples, the crotch panel 412 can include a different size than that depicted in FIG. 7. For example, the back edge 712 can extend further up the back torso portion 510. In some examples, the back edge 712 can extend to, and attach near, a yoke seam. In some examples, the back edge 712 can extend to, and attach near, a waistband.

In at least some examples, the crotch panel 412 includes a spacer fabric layer 718 that forms, at least in part, an innermost-facing surface 720 of the lower-body garment 100 such that the spacer fabric layer 718 is in contact with a wearer's crotch area when the lower-body garment 100 is worn. In example aspects, a moisture-barrier layer (not shown in FIG. 7) is secured to an outer-facing surface of the spacer fabric layer 718 to form a leak protection composite structure as shown in FIGS. 8A and 8B.

Figure 8A:
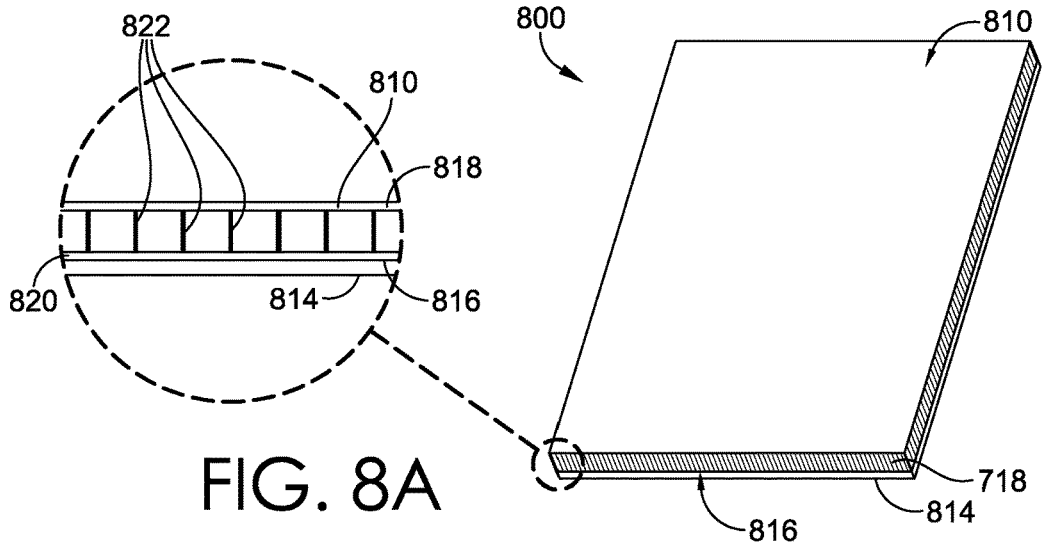
FIG. 8A illustrates a perspective view of a first surface of a leak protection composite structure for use in example lower-body garments described herein in accordance with aspects herein.
Figure 8B:
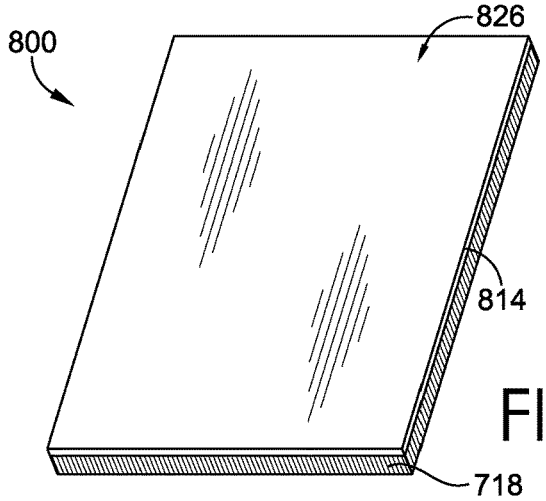
FIG. 8B illustrates a perspective view of an opposite second surface of the leak protection composite structure of FIG. 8A in accordance with aspects herein.

FIG. 8A depicts a perspective view of a first surface 810 of a leak protection composite structure 800 that may form, at least in part, the crotch panel 412. The first surface 810 may correspond to the innermost-facing surface 720 of the crotch panel 412. FIG. 8B depicts a perspective view of an opposite second surface 826 of the leak protection composite structure 800. The second surface 826 may correspond, in some aspects, to an outer-facing surface of the crotch panel 412.

The leak protection composite structure 800 includes the spacer fabric layer 718 of the crotch panel 412. The first surface 810 of the leak protection composite structure 800 corresponds to the first surface of the spacer fabric layer 718. A moisture-barrier layer 814 is secured to an opposite second surface 816 of the spacer fabric layer 718 and forms the second surface 826 of the leak protection composite structure 800.

As depicted in the enlarged view, the spacer fabric layer 718 includes a first layer 818 that forms the first surface 810, an opposite second layer 820 that forms the second surface 816 of the spacer fabric layer 718, and a plurality of tie yarns 822 that interconnect the first layer 818 and the second layer 820. The plurality of tie yarns 822 are oriented generally orthogonal to a surface plane of each of the first layer 818 and the second layer 820. In example aspects, the spacer fabric layer 718 may have a weight from about 200 gsm to about 300 gsm, from about 220 gsm to about 280 gsm, or about 240 gsm. In example aspects, the first layer 818 and the second layer 820 may be formed from the same yarn types. For example, both the first layer 818 and the second layer 820 may include about 60% polyester, including recycled polyester, and about 40% elastane, from about 65% polyester and about 35% elastane, or about 66% polyester and about 34% elastane. In some examples, the polyester can be recycled polyester or virgin polyester or a combination thereof. The polyester yarns may, in example aspects, wick menstrual blood and/or urine to the space between the first and second layers 818 and 820 via capillary action between filaments forming the individual yarns and between the yarns themselves.

In some examples, the first layer 818 and the second layer 820 can include 30D/36F polyester (e.g., virgin or recycled) and 20D elastane.

The plurality of tie yarns 822 may include elastic yarns (e.g., elastane). For example, the tie yarns 822 may include elastic yarns having a denier of about 40.

In some examples, the first layer 818 and the second layer 820 can be formed of different yarn types. For example, the first layer 818 can comprise a yarn that is more hydrophilic. In some example, the tie yarns 822 can include varied properties, such as compositional material, denier, and the like. For example, the tie yarns within the same spacer fabric panel can include different compositional materials and/or different sizes (e.g., different lengths between knit layers, different diameters, different deniers, etc.).

In example aspects, the moisture-barrier layer 814 is secured to the spacer fabric layer 718 through a lamination process such that a cohesive, unitary structure is formed. In example aspects, the lamination process may include a dot lamination process. As stated, the moisture-barrier layer 814 may be formed of a material that is substantially or totally impervious to moisture or liquid include menstrual blood and/or urine. In one example, the moisture-barrier layer 814 may include a thermoplastic material (e.g., film), such as a thermoplastic elastomer (TPE) film, although other moisture impervious materials are contemplated as being within aspects herein. In some examples, the moisture-barrier layer 814 is relatively thin. For example, the moisture-barrier layer 814 can include a thickness in a range of about 10 micrometers to about 15 micrometers. In some examples, the moisture-barrier layer 814 is about 12 micrometers. The relatively thin construction of the moisture-barrier layer 814 can, in at least some instances, contribute to a thin overall construction, which can provide for a less bulky (but still absorbent) textile for imparting leak protection functionality to various garments.

Figure 9:
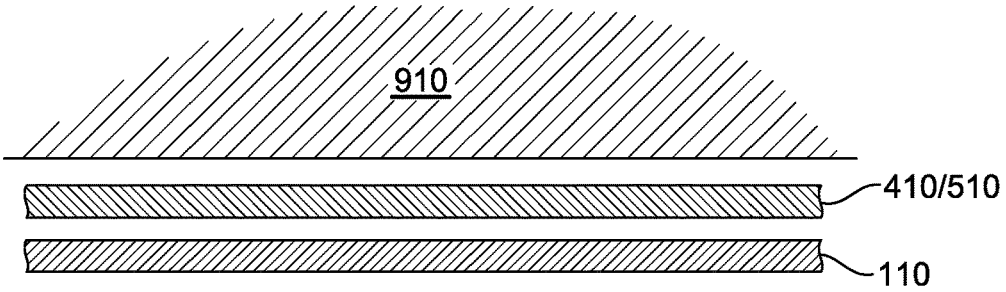
FIG. 9 illustrates a cross section of a portion of an example lower-body garment described herein taken at one or more of a front torso panel and a back torso panel of an internal assembly of the lower-body garment in accordance with aspects herein.
Figure 10:
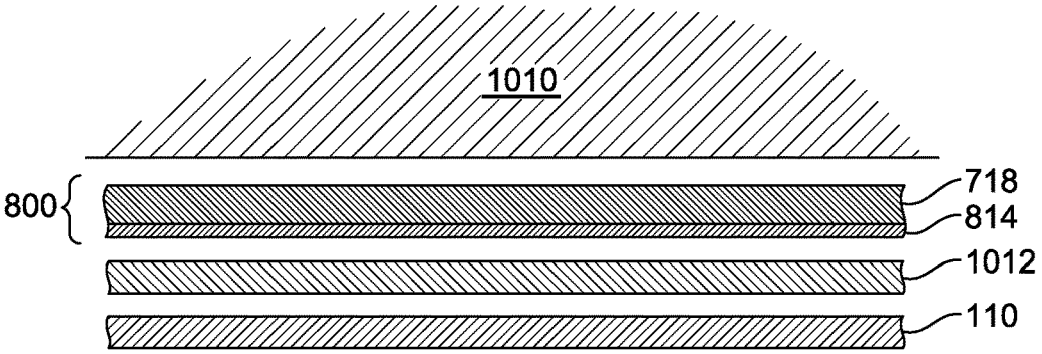
FIG. 10 illustrates a first example cross section taken at a crotch panel of an internal assembly of an example lower-body garment described herein in accordance with aspects herein.
Figure 11:
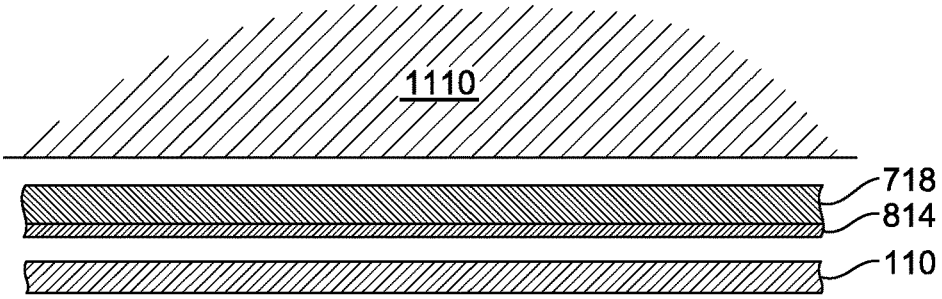
FIG. 11 illustrates a second example cross section taken at a crotch panel of an internal assembly of an example lower-body garment described herein in accordance with aspects herein.

FIGS. 9-11 depict some example cross-sectional views of different portions of the lower-body garment 100. For example, FIG. 9 represents an example cross-section taken at the front torso portion 410 and/or the back torso portion 510. As depicted, the front torso portion 410 and/or the back torso portion 510 is positioned adjacent to a wearer's skin surface 910 and is further positioned internal to the external layer 110. The front torso portion 410 and/or the back torso portion 510 is generally unaffixed from or not attached to the external layer 110 as shown except for the respective upper edges 414 and 512 and the respective side edges 610 and 616 of the front torso portion 410 and the back torso portion 510.

FIG. 10 depicts a first example cross-section taken at the area of the lower-body garment 100 corresponding to the crotch panel 412. As depicted, the spacer fabric layer 718 is positioned adjacent to a skin surface 1010 of a wearer, and the moisture-barrier layer 814 is shown secured to the spacer fabric layer 718. In at least some examples, an additional layer 1012 may be positioned external to the moisture-barrier layer 814, and the additional layer 1012 may comprise a continuous extension of the front torso portion 410 and the back torso portion 510. The additional layer 1012 may be wrapped around the first and second side edges 714 and 716 of the crotch panel 412 to prevent the edges of the moisture-barrier layer 814 from contacting, for example, the wearer's legs thereby improving wearer comfort. The external layer 110 of the lower-body garment 100 is positioned external to the additional layer 1012. As shown, the external layer 110 may not be directly secured to the additional layer 1012.

FIG. 11 depicts a second example cross-section taken at the area of the lower-body garment 100 corresponding to the crotch panel 412. As depicted, the spacer fabric layer 718 is positioned adjacent to a skin surface 1110 of a wearer, and the moisture-barrier layer 814 is shown secured to the spacer fabric layer 718. The cross-section depicted in FIG. 11 does not include the additional layer 1012. As such, the external layer 110 of the lower-body garment 100 is positioned external to the moisture-barrier layer 814. As shown, the external layer 110 may not be directly secured to the moisture-barrier layer 814 such that a potential space is present between the external layer 110 and the moisture-barrier layer 814.

Figure 14:
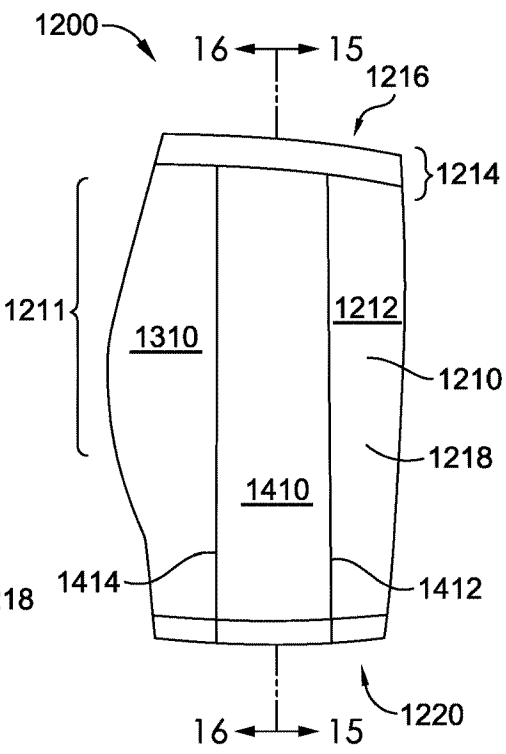
FIG. 14 illustrates a side view of the exterior of the second example lower-body garment of FIG. 12 in accordance with aspects herein wherein an opposite side view would be the same.
Figure 13:
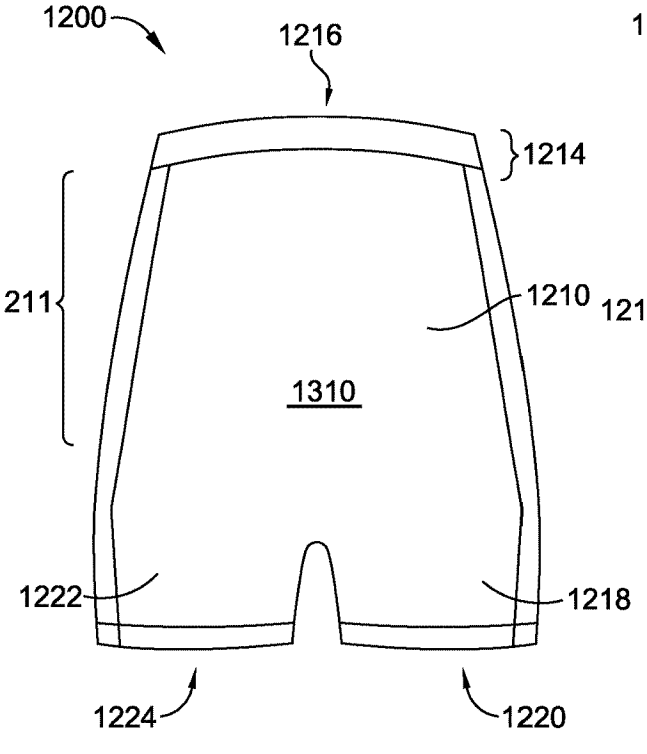
FIG. 13 illustrates a back view of the exterior of the second example lower-body garment of FIG. 12 in accordance with aspects herein.
Figure 12:
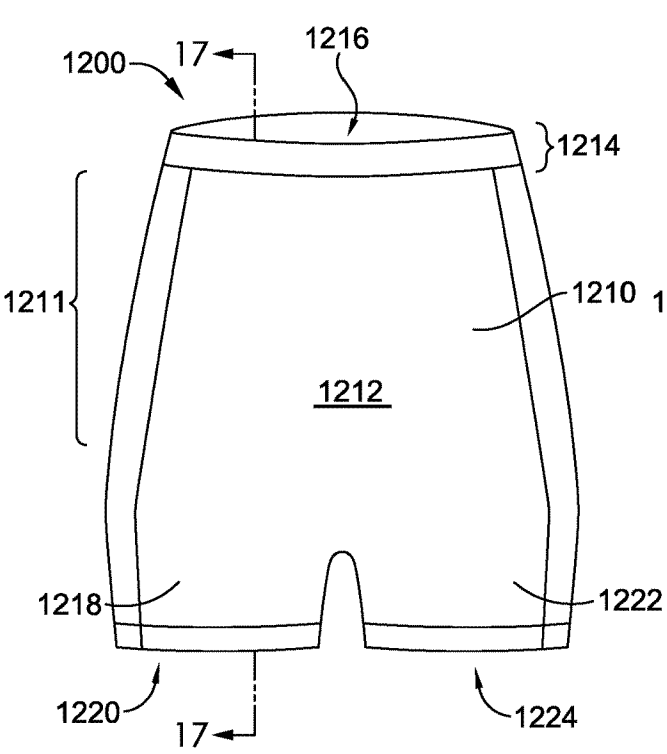
FIG. 12 illustrates a front view of an exterior of a second example lower-body garment in accordance with aspects herein.

FIGS. 12-17 depict a second example lower-body garment 1200 that has built-in leak protection features in accordance with aspects herein. FIGS. 12-14 respectively illustrate a front view, a back view, and a side view of an exterior of the lower-body garment 1200. The lower-body garment 1200 is shown in the form of a short but aspects herein contemplate that the lower-body garment 1200 may be in the form of an "underwear-type" garment (also known as a boy short), a capri, a legging, a unitard, and the like.

In example aspects, the exterior of the lower-body garment 1200 is formed from an external layer 1210 such that the external layer 1210 forms a torso portion 1211 including a front torso portion 1212 (seen in FIG. 12) and a back torso portion 1310 (seen in FIG. 13) that together define, at least in part, a waist opening 1216. In example aspects, the lower-body garment 1200 may optionally include a waistband 1214 that further defines the waist opening 1216. The external layer 1210 also optionally forms a first leg portion 1218 having a first leg opening 1220 and a second leg portion 1222 having a second leg opening 1224. In example aspects where the lower-body garment 1200 does not include the first and second leg portions 1218 and 1222, the first and second leg openings 1220 and 1224 would be located on the torso portion 1211 (similar to an underwear-type garment).

In the side view of the lower-body garment 1200 depicted in FIG. 14, the external layer 1210 further includes a side panel 1410 that extends generally vertically from a lower edge of the waistband 1214 to the first leg opening 1220. An opposite side view of the lower-body garment 1200 would also include a side panel that extends from the lower edge of the waistband 1214 to the second leg opening 1224. As such, the description of the side panel 1410 is also applicable to the side panel located on the opposite side. The side panel 1410 may be a separate panel that is secured or joined to portions of the external layer 1210 forming the front torso portion 1212, the first leg portion 1218, and the back torso portion 1310 at a first seam 1412 and a second seam 1414. The first and second seams 1412 and 1414 may be formed using affixing technologies such as stitching, bonding, adhesives, welding, and the like.

Similar to the external layer 110, the external layer 1210 comprises, for example, a knit or woven textile having elastic yarns. Because the external layer 1210 is formed using, at least in part, elastic yarns, the external layer 1210 closely conforms to the underlying morphology of a wearer as shown in FIGS. 12-14 (i.e., the external layer 1210 is form fitting).

Figure 16:
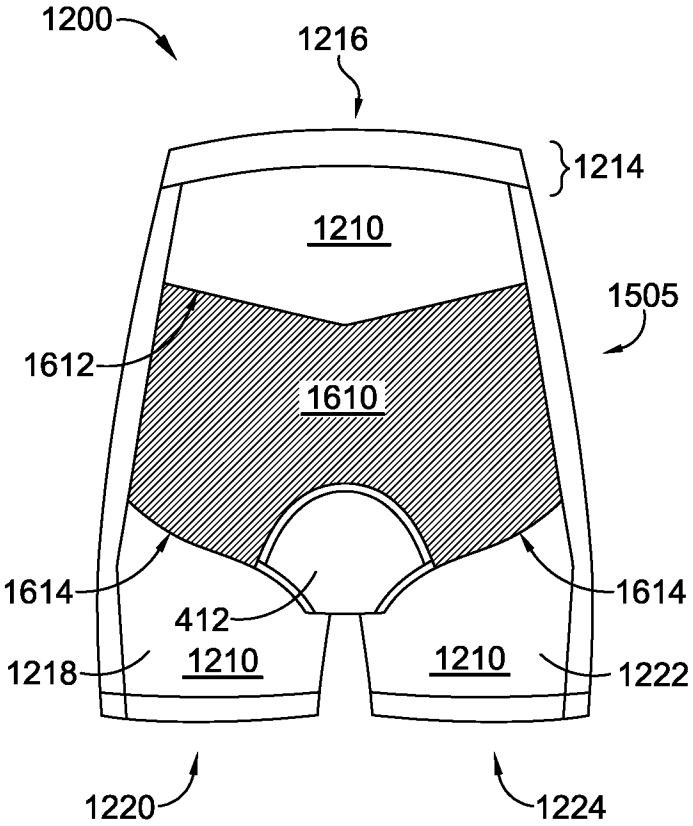
FIG. 16 illustrates a back view of the interior of the second example lower-body garment of FIG. 12 in accordance with aspects herein.
Figure 15:
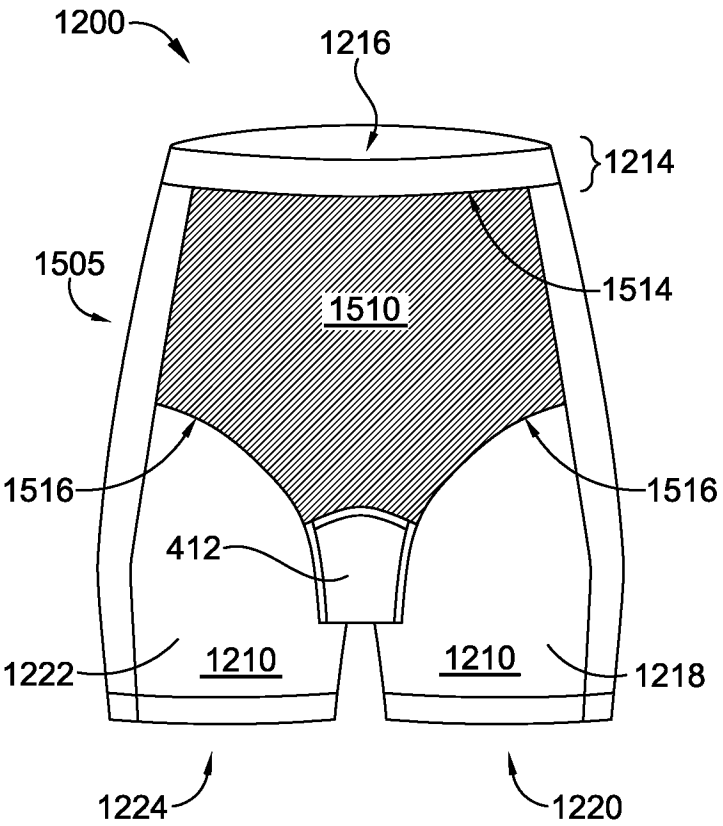
FIG. 15 illustrates a front view of an interior of the second example lower-body garment of FIG. 12 in accordance with aspects herein.
Figure 17:
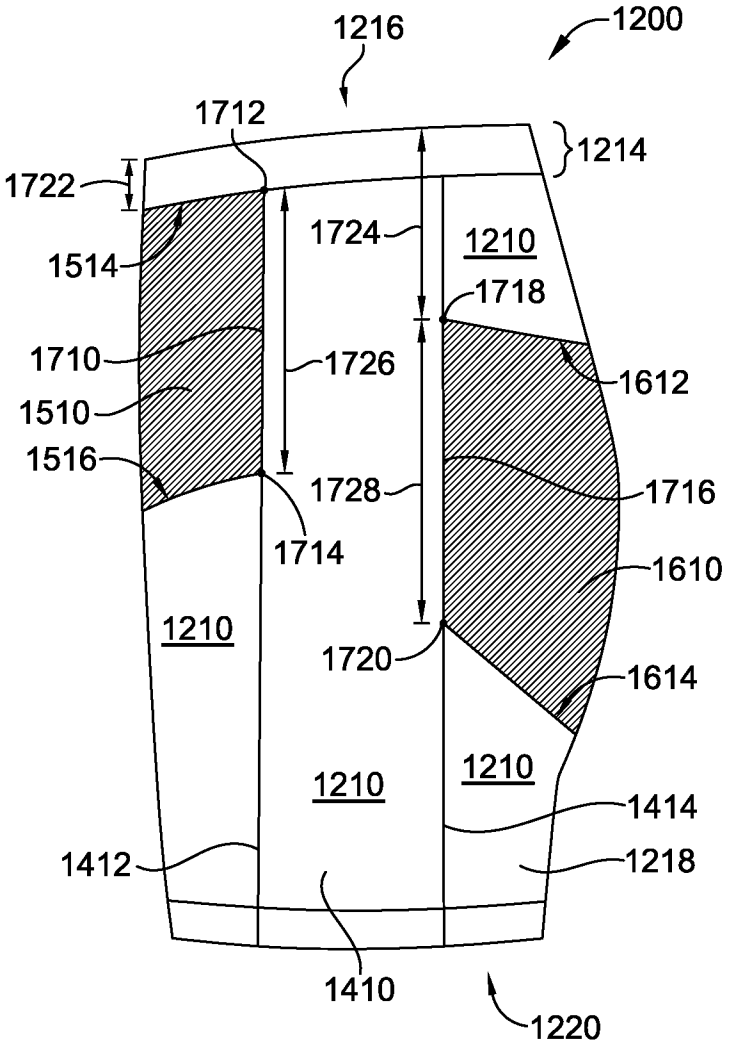
FIG. 17 illustrates a side view of the interior of the second example lower-body garment of FIG. 12 in accordance with aspects herein where an opposite side view would be the same.

FIGS. 15-17 respectively illustrate front, back, and side views of the lower-body garment 1200 but from the perspective of the interior of the lower-body garment 1200 where the interior would not be viewable by an observer viewing the lower-body garment 1200 as worn by a wearer. In example aspects, the lower-body garment 1200 includes an internal assembly referenced generally by the numeral 1505. With respect to FIG. 15, the internal assembly 1505 includes a front torso panel 1510 (shown with hatching) configured to cover a front lower torso of a wearer. In example aspects, and as shown, the front torso panel 1510 does not include leg portions.

The front torso panel 1510 includes a front upper edge 1514 and front lower edges 1516. In example aspects, the front upper edge 1514 is permanently secured to the external layer 1210 by way of, for example, stitching, bonding, and the like. Further, in example aspects, the front upper edge 1514 is permanently secured adjacent to (e.g., from about 0.1 mm to about 4 cm) the waist opening 1216. When the lower-body garment 1200 includes a waistband such as the waistband 1214, the front upper edge 1514 is permanently secured to a lower edge of the waistband 1214. In example aspects, the front lower edges 1516 are free, terminal edges that are not secured or affixed to the external layer 1210. In further example aspects, the front lower edges 1516 may include raw, cut edges of the material used to form the front torso panel 1510. Stated differently, the front lower edges 1516 may be unhemmed and may not include any trim pieces to provide a clean aesthetic and minimize the appearance of panty lines on the lower-body garment 1200. FIG. 15 further depicts a portion of the crotch panel 412.

With respect to FIG. 16, the internal assembly 1505 further includes a back torso panel 1610 (shown with hatching) configured to cover a back lower torso of a wearer. In example aspects, and as shown, the back torso panel 1610 does not include leg portions. The back torso panel 1610 includes a back upper edge 1612 and back lower edges 1614. In example aspects, the back upper edge 1612 is permanently secured to the external layer 1210 by way of, for example, stitching, bonding, and the like. Further, in example aspects, the back upper edge 1612 is positioned lower than the front upper edge 1514 of the front torso panel 1510 with respect to the waist opening 1216. When the lower-body garment 1200 includes a waistband such as the waistband 1214, the back upper edge 1612 is permanently secured below a lower edge of the waistband 1214 such as, for example, about 2 cm to about 15 cm below the lower edge of the waistband 1214. In example aspects, the back lower edges 1614 are free, terminal edges that are not secured or affixed to the external layer 1210. In further example aspects, the back lower edges 1614 may include raw, cut edges of the material used to form the back torso panel 1610. Stated differently, the back lower edges 1614 may be unhemmed and may not include any trim pieces to provide a clean aesthetic and minimize the appearance of panty lines on the lower-body garment 1200. FIG. 16 further depicts a portion of the crotch panel 412. In example aspects, the front torso panel 1510 and the back torso panel 1610 may both be formed of the same lightweight knit material having elastic yarns and polyester yarns that was described with respect to front torso portion 410 and back torso portion 510 of the lower-body garment 100.

FIG. 17 depicts the side view of the interior of the lower-body garment 1200 including the side panel 1410 formed from the external layer 1210. As depicted, the front torso panel 1510 includes a first side edge 1710 that has an upper end 1712 and a lower end 1714. In example aspects, the first side edge 1710 is secured along its length 1726 to the side panel 1410 of the external layer 1210 at the first seam 1412. In example aspects, the upper end 1712 of the first side edge 1710 is positioned a distance 1722 below the waist opening 1216. The back torso panel 1610 further includes a first side edge 1716 that has an upper end 1718 and a lower end 1720. In example aspects, the first side edge 1716 is secured along its length 1728 to the side panel 1410 at the second seam 1414. Additionally, the upper end 1718 of the first side edge 1716 is positioned a distance 1724 below the waist opening 1216, where the distance 1724 is greater than the distance 1722. As depicted in FIG. 17, the first side edge 1710 of the front torso panel 1510 is spaced apart from the first side edge 1716 of the back torso panel 1610 by the side panel 1410 such that the first side edge 1710 is unaffixed from or is not directly secured to the first side edge 1716. The same configuration is present on the second opposite side of the lower-body garment 1200.

Similar to the lower-body garment 100, the configuration shown, for example, in FIG. 17 provides a number of different advantages. By decoupling the front torso panel 1510 from the back torso panel 1610 at the respective first side edges 1710 and 1716, the front lower edges 1516 may be positioned significantly higher than the back lower edges 1614 to provide a generally unrestricted range of motion when the wearer raises their leg in a forward direction (e.g., the front lower edge 1516 is positioned above a hip flexion area). This is achieved, at least in part, by positioning the lower end 1714 of the first side edge 1710 of the front torso panel 1510 closer to the waist opening 1216 than the lower end 1720 of the first side edge 1716 of the back torso panel 1610. This configuration also minimizes panty lines. The back lower edges 1614 may be positioned significantly lower than the front lower edges 1516 to provide to provide full coverage of the wearer's buttocks (e.g., the back lower edges 1614 may be positioned below the gluteal fold). This is achieved, at least in part, by positioning the lower end 1720 of the first side edge 1716 of the back torso panel 1610 farther away from the waist opening 1216 compared to the lower end 1714 of the first side edge 1710 of the front torso panel 1510. This configuration also minimizes panty lines.

Moreover, positioning the back upper edge 1612 of the back torso panel 1610 below or inferior to the front upper edge 1514 of the front torso panel 1510 may minimize material waste by ensuring that only the fuller, more rounded parts of the wearer's buttocks are covered by the back torso panel 1610. To describe this differently, positioning the upper end 1718 of the first side edge 1716 of the back torso panel 1610 a greater distance (e.g., distance 1724) below the waist opening 1216 compared to the upper end 1712 of the first side edge 1710 of the front torso panel 1510 (e.g., distance 1722) minimizes material waste by ensuring that only the fuller, more rounded parts of the wearer's buttocks are covered by the back torso panel 1610. FIGS. 12-16 depict an example in which the back upper edge 1612 is lower. In other examples, the back upper edge 1612 can extend all the way up to the waist opening and/or to the waistband 1214 (e.g., the back upper edge 1612 can attach closer to the waistband 1214 and above the yoke seam).

Figure 18:
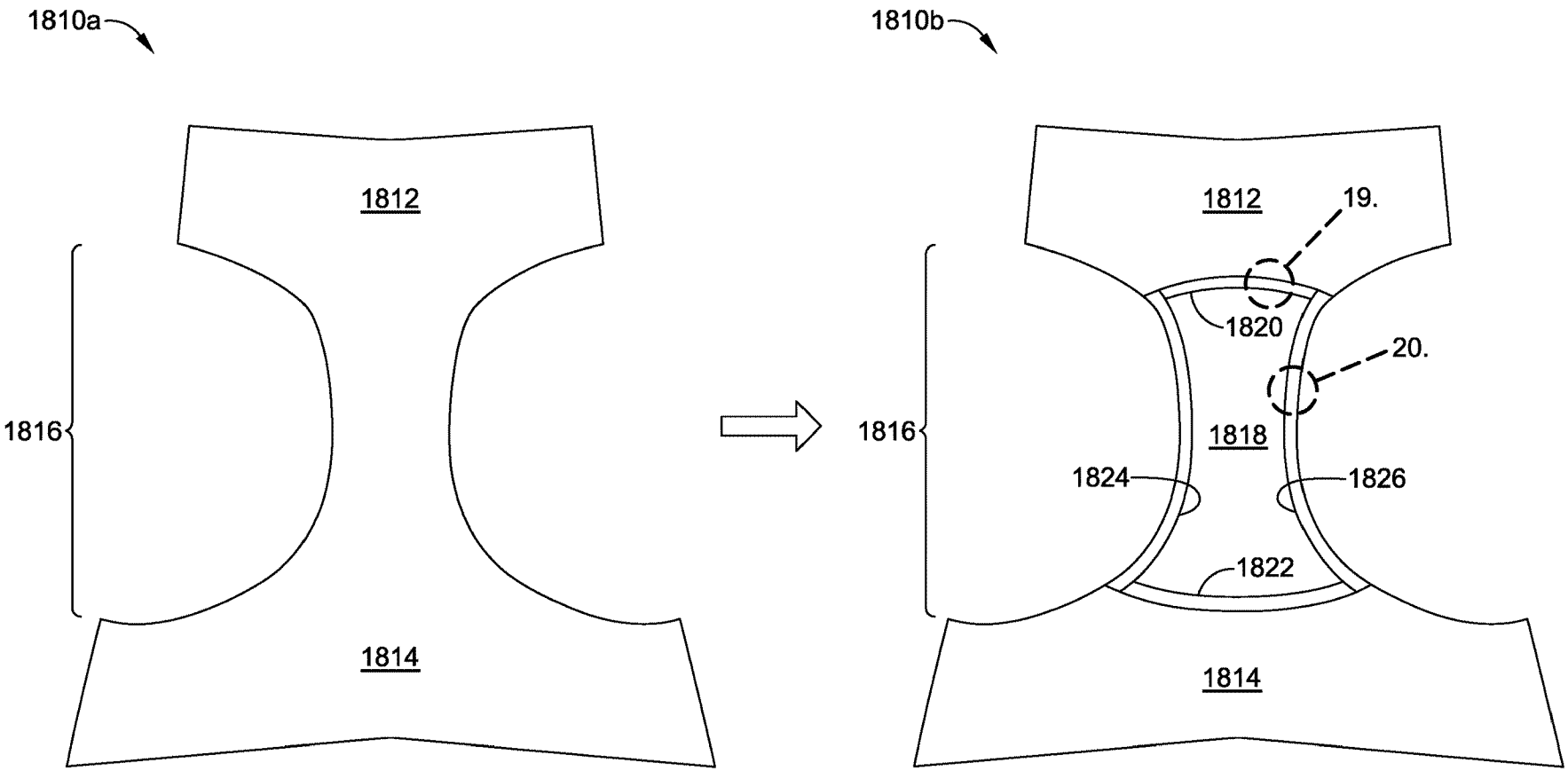
FIG. 18 illustrates an example process for incorporating a crotch panel into an internal assembly in accordance with aspects herein.

FIG. 18 depicts an example way of incorporating the crotch panel 412 into various types of lower-body garments or internal assemblies, such as the lower-body garment 100, the lower-body garment 1200, the lower-body garment 2310, or any other lower-body garment described in this disclosure, or the equivalent thereof. Reference numeral 1810*a* indicates a portion of an internal assembly that includes a front torso portion 1812 which may be the front torso portion 410 or 1510, a back torso portion 1814 which may be the back torso portion 510 or 1610, and a crotch area 1816 that continuously extends between the front torso portion 1812 and the back torso portion 1814. In example aspects, the front torso portion 1812, the back torso portion 1814, and the crotch area 1816 may include a continuous panel of material without seams.

Figure 19:
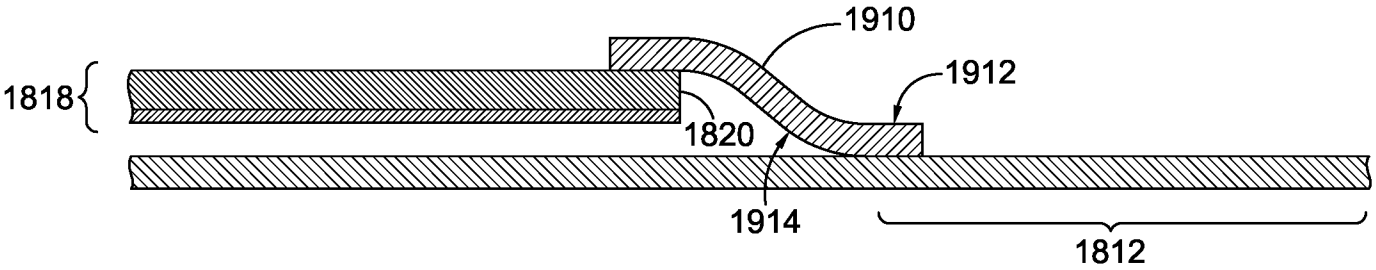
FIGS. 19-20 illustrate various examples of bonded seams for use in the lower-body garment described herein in accordance with aspects herein.
Figure 20:
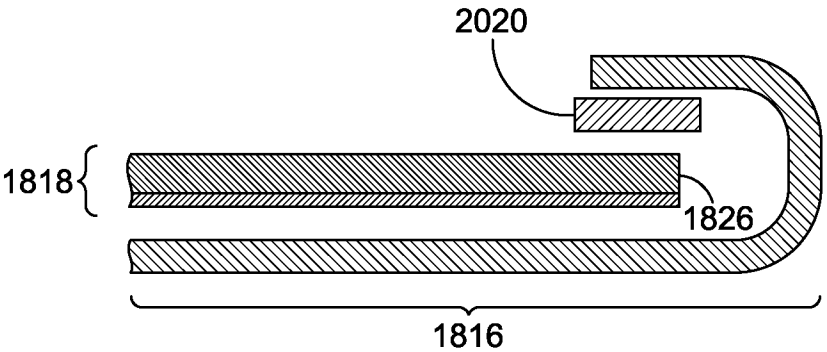

At reference numeral 1810*b*, a leak protection composite structure 1818 which may be the leak protection composite structure 800 is positioned on an inner-facing surface of the crotch area 1816 (e.g., configured to face towards the wearer) and is secured thereto as described with respect to FIGS. 19 and 20. In examples, the material forming the crotch area 1816 can protect a moisture-barrier layer (e.g., 814) associated with the leak protection composite structure 1818. For example, the material forming the crotch area 1816 (e.g., as well as the front torso portion 1812 and the back torso portion 1814) can include a DWR treated textile, such as a DWR treated knit textile (e.g., similar to the knit textile forming the portions 410 and 510). The leak protection composite structure 1818 includes a front edge 1820, a back edge 1822, a first side edge 1824, and an opposite second side edge 1826.

FIG. 19 illustrates one example way of securing the front edge 1820 and/or the back edge 1822 of the leak protection composite structure 1818 to the front torso portion 1812 and/or the back torso portion 1814 respectively. In one example aspect, a bonding strip 1910, such as a hotmelt tape or other type of adhesive tape, may be positioned to cover the front edge 1820 and/or the back edge 1822 of the leak protection composite structure 1818 and to also partially cover the front torso portion 1812 and/or the back torso portion 1814. Application of heat and/or pressure to the bonding strip 1910 causes it to bond the front edge 1820 and/or the back edge 1822 to the respective front torso portion 1812 and/or the back torso portion 1814. Using a bonding strip as opposed to, for example, stitching creates a low-profile bonded area to minimize panty lines and to reduce the chance of chafing due to threads used in stitching.

In at least some examples, the bonding strip 1910 can include a multi-layer bonding strip, which includes an outer textile layer (e.g., knit, nonwoven, or woven) on an outer face 1912 and an inner adhesive layer on an inner face 1914 and between the outer textile layer and the leak protection composite structure 1818. In some examples, the outer textile layer comprises a knit textile (e.g., similar to the knit textile forming the portions 410, 510, 1812, and 1814). In some examples, the outer textile layer an include a DWR treated textile layer. The multi-layer bonding strip can, in some instances, operate to help seal the edges (e.g., 1820) of the leak protection composite structure 1818 to reduce the likelihood of moisture leaking. In addition, the outer textile layer can provide a softer finish (e.g., as compared to bare seam tape, stitching, or other seaming structures) the reduce the likelihood of discomfort to the wearer.

FIG. 20 illustrates one example way of finishing the first and second side edges 1824 and 1826 of the leak protection composite structure 1818. As shown, material from the crotch area 1816 may be wrapped around each of the first and second side edges 1824 and 1826 and secured thereto using an adhesive tape 2020 such as a hotmelt adhesive tape. In some examples, the edge of the material from the crotch area wrapping around the first and second side edges 1824 and 1826 can form a hem. Wrapping the first and second side edges 1824 and 1826 of the leak protection composite structure 1818 can prevent the moisture barrier layer from contacting a wearer's skin surface, which may improve wearer comfort. Other example ways of attaching the leak protection composite structure 1818 to the front and back torso panels 1812 and 1814, including stitching, are contemplated as being within aspects herein.

In some examples, the edge finishing associated with the first and second side edges 1824 and 1826 can reduce the likelihood of moisture leaking from the leak protection composite structure 1818. For example, as depicted in FIG. 20, the wrapping side edge (e.g., hem) of the crotch area 1816 forms an envelope that binds the edge 1826 of the leak protection composite structure 1818. In at least some examples, the textile forming the crotch area 1816 and the wrapping side edge includes a DWR treatment (e.g., such as the DWR treatment incorporated throughout the textile as described in other parts of this disclosure), which can significantly reduce the likelihood of leakage (e.g., as compared to a non-DWR treated textile).

Figure 21:
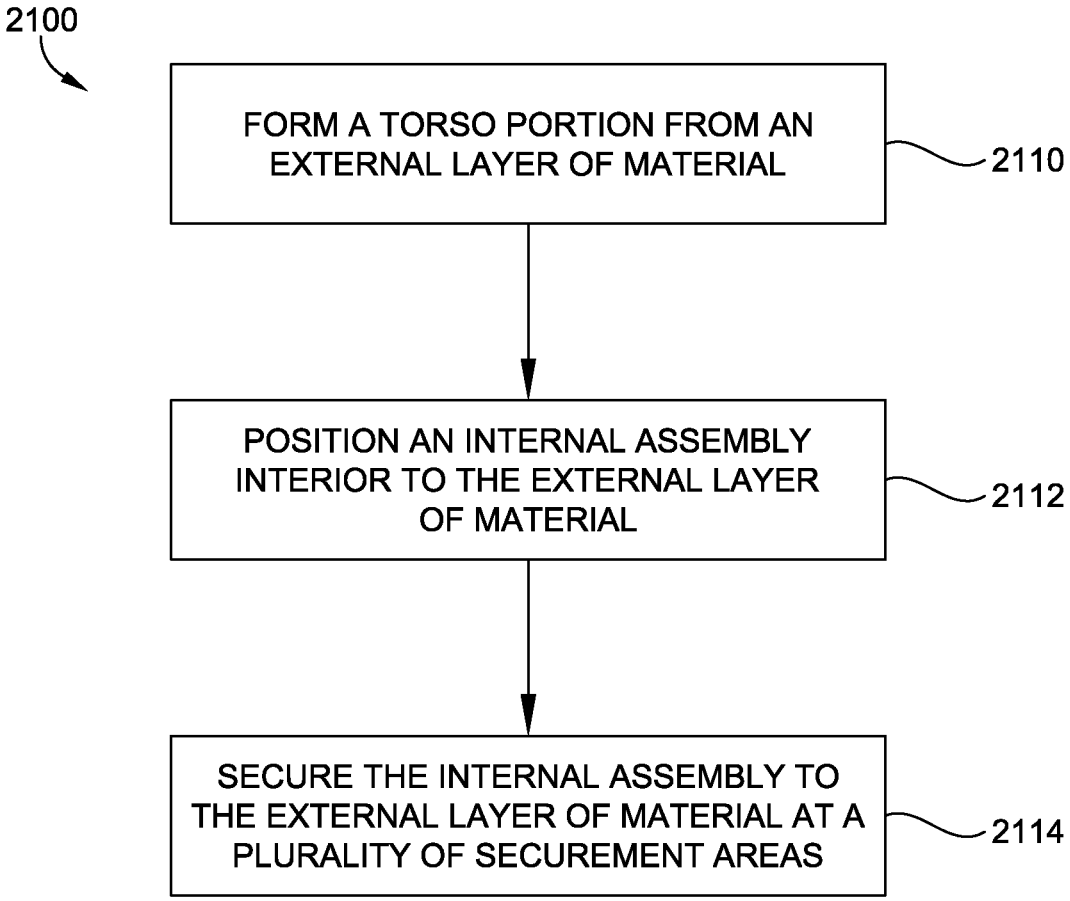
FIG. 21 illustrates a flow diagram of an example method of manufacturing a lower-body garment having leak protection features in accordance with aspects herein.

FIG. 21 illustrates a flow diagram of an example method 2100 of manufacturing a lower-body garment such as the lower-body garment 100 or 1200 described herein. At a step 2110, a torso portion of the lower-body garment is formed from an external layer of material such as the external layer 110 or 1210 where the torso portion has at least a waist opening, a first leg opening, and a second leg opening. At a step 2112, an internal assembly such as the internal assembly 405 or 1505 is positioned internal to the external layer of material. The internal assembly includes a front torso panel such as the front torso portion 410 or 1510, a back torso panel such as the back torso portion 510 or 1610, and a crotch panel such as the crotch panel 412. The crotch panel is positioned between the first and second leg openings and joins the front torso panel to the back torso panel. The crotch panel includes a spacer fabric layer such as the spacer fabric layer 718 and a moisture barrier layer such as the moisture-barrier layer 814 where the spacer fabric layer forms, in part, an innermost-facing surface of the lower-body garment. At a step 2114, the internal assembly is secured to the external layer of material at a plurality of securement areas such as, for example, at a waistband of the lower-body garment and at side panels of the lower-body garment (e.g., seams 312 and 314 of the lower-body garment 100, and seams 1412 and 1414 of the lower-body garment 1200).

In examples of the present disclosure, a leak protection composite structure (e.g., textile, multi-layer textile, laminate, etc.) can include various features and properties and can be incorporated into a variety of different articles (e.g., articles of apparel). For example, FIG. 8 is associated with an example leak protection composite structure 800, which includes a spacer textile 718 and a moisture-barrier layer 814. In at least some examples, a leak protection composite structure can include one or more additional layers, such as depicted in FIGS. 22A-22C.

Figure 22A:
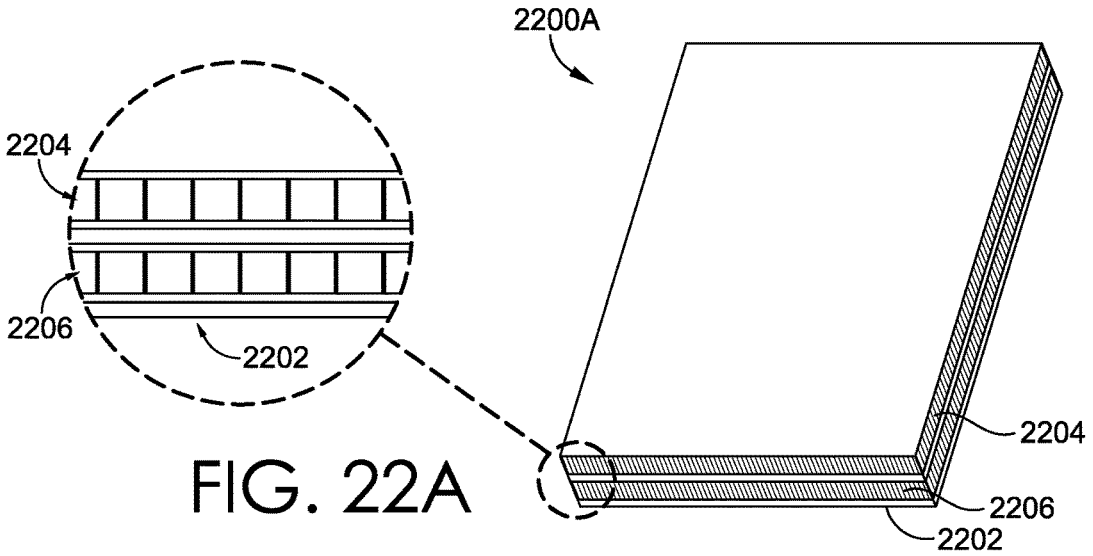
FIG. 22A illustrates a composite textile including two or more layers of spacer fabric according to an example.
Figure 22B:
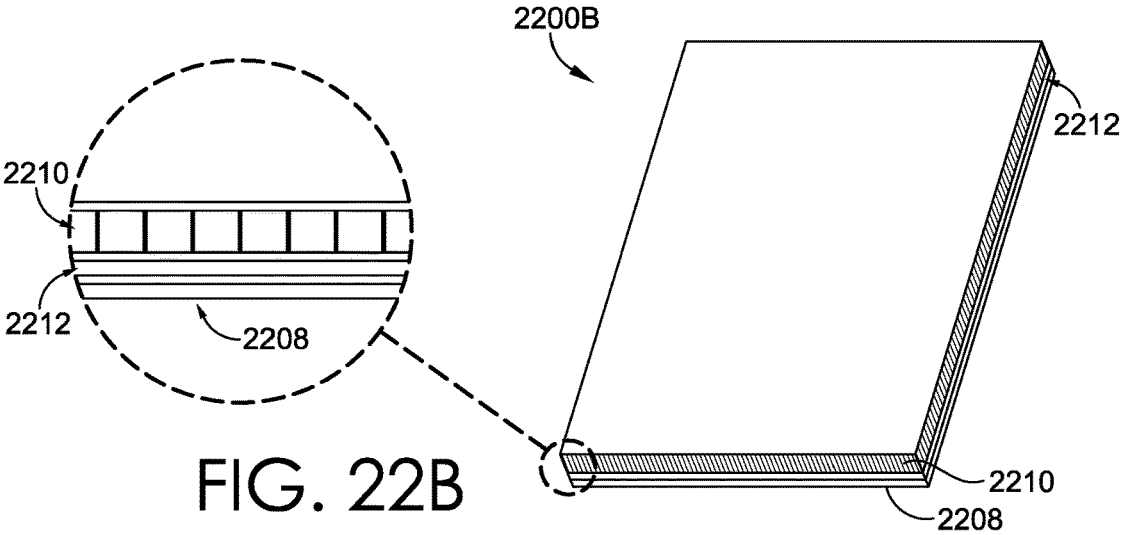
FIG. 22B illustrates a composite textile including at least one additional textile layer between a spacer fabric and a moisture-barrier membrane according to an example.
Figure 22C:
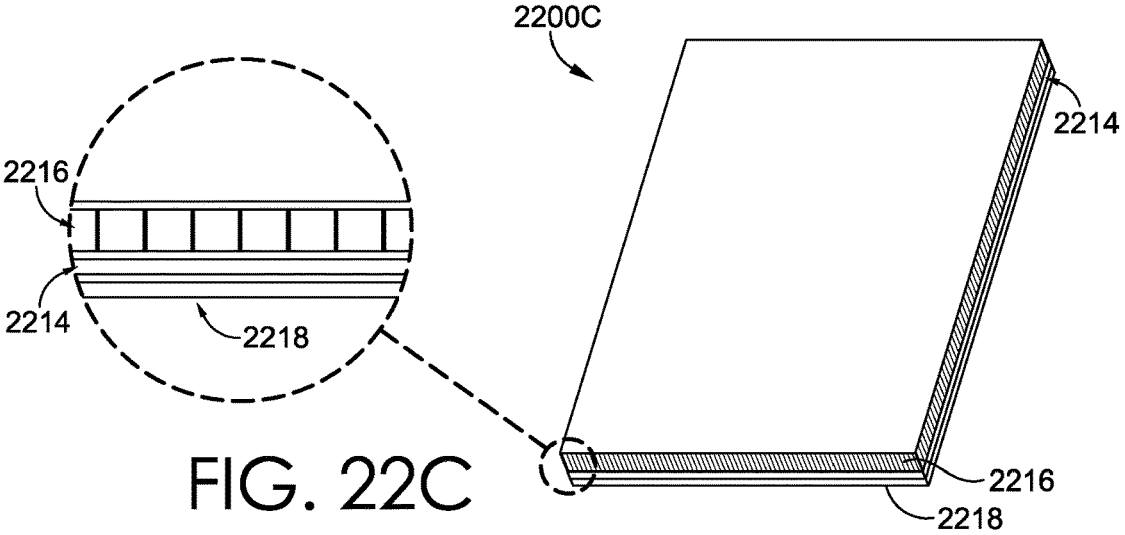
FIG. 22C illustrates a composite textile including one or more additional textile layers affixed to a moisture-barrier membrane according to an example.
Figure 23A:
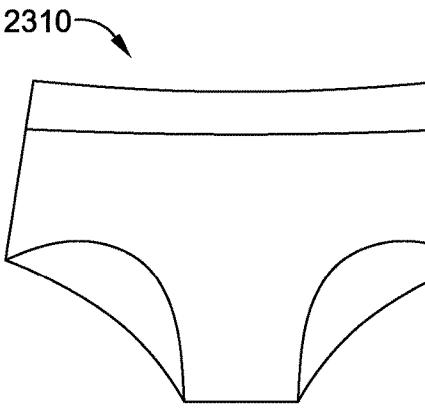
FIGS. 23A-23E depict another lower-body garment with a leak protection composite structure according to examples of this disclosure.
Figure 23B:
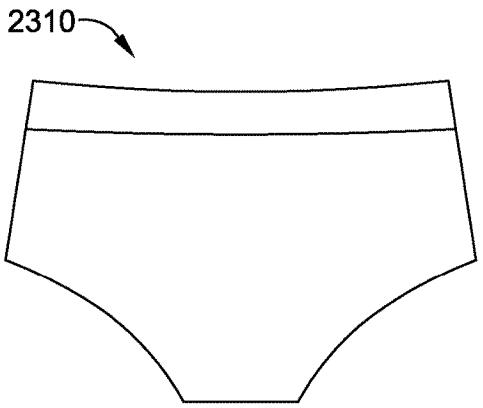
Figure 23C:
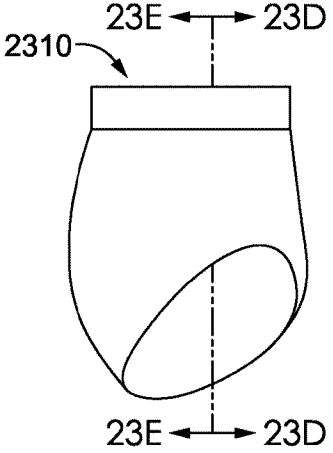
Figure 23D:
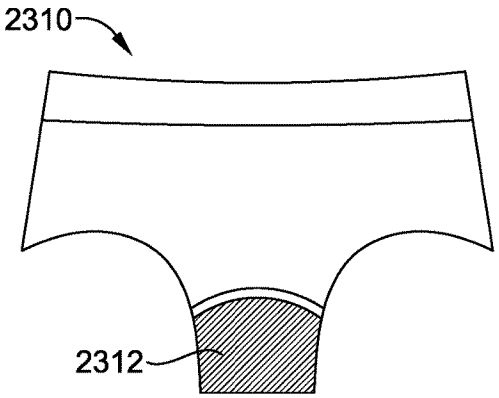
Figure 23E:
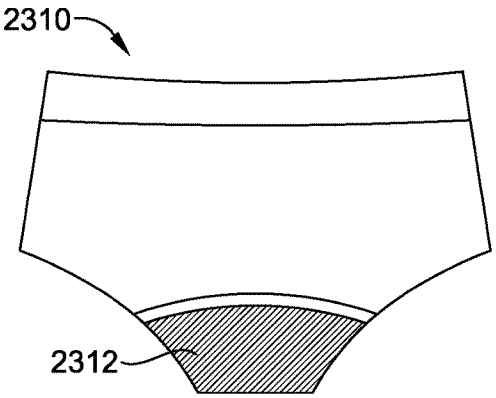

In at least some examples, and referring to FIG. 22A, a leak protection composite structure 2200A can include a plurality of layers of spacer textile, which can be coupled to a moisture-barrier layer 2202 (e.g., having any of the properties of a moisture-barrier textile described in this disclosure). For example, the leak protection composite structure 2200A includes a first layer of spacer textile 2204 and a second layer of spacer textile 2206, and each of the layers 2204 and 2206 can include a spacer textile having any of the properties associated with spacer textiles described in this disclosure (e.g., first textile layer and second textile layer connected by tie yarns). In at least some examples, the moisture-barrier layer 2202 and the spacer textiles 2204 and 2206 are bonded (e.g., laser bonded, adhesively bonded, or otherwise combined) together as a laminate. Among other things, the plurality of layers of spacer textile 2204 and 2206 can increase the moisture absorption and capture capabilities associated with the leak protection composite structure 2200A (e.g., as compared to the composite 800). In examples, the leak protection composite structure 2200A can be incorporated into any of the garments or articles of apparel described in this disclosure.

In at least some examples, a leak protection composite structure 2200B (FIG. 22B) can include one or more additional layers of textile positioned between a moisture-barrier layer 2208 (e.g., having any of the properties of a moisture-barrier textile described in this disclosure) and a spacer textile 2210 (e.g., having any of the properties of a spacer textile described in this disclosure). For example, the leak protection composite structure 2200B can include one or more additional absorptive layers 2212 coupled between the moisture-barrier layer 2208 and the spacer textile 2210. Examples of an additional absorptive layer 2212 can include a textile having yarns (e.g., fibers) with absorptive properties. In at least some examples, the additional absorptive layer 2212 can include a textile (e.g., knit, woven, nonwoven, etc.) with natural fibers (e.g., cotton). In at least some examples, the moisture-barrier layer 2208, the spacer textile 2210, and the additional absorptive layer 2212 are bonded (e.g., laser bonded, adhesively bonded, or otherwise combined) together as a laminate. Among other things, the combination of the spacer textile 2210 and the additional absorptive layer 2212 can increase the moisture absorption and capture capabilities associated with the leak protection composite structure 2200B (e.g., as compared to the composite 800). In examples, the leak protection composite structure 2200B can be incorporated into any of the garments or articles of apparel described in this disclosure.

In at least some examples, a leak protection composite structure 2200C (FIG. 22C) can include a moisture-barrier layer 2214 with a spacer textile 2216 bonded to one side (e.g., similar to the leak protection composite structure 800) and with one or more additional layers of textile 2218 bonded to the opposing side. In at least some examples, the one or more additional layers of textile 2218 can include any of a variety of different textiles (e.g., knit, woven, nonwoven, etc.), including textiles that could form an outer face of an article of apparel.

In at least some examples, the one or more additional layers of textile 2218 can include a lightweight knit material having elastic yarns, such as the material forming the front torso portion 410 and the back torso portion 510. For example, the one or more additional layers of textile 2218 can have a weight from about 100 grams per square meter (gsm) to about 150 gsm, from about 120 gsm to about 140 gsm, or about 125 gsm. The lightweight features of the material may be achieved by using a single knit construction such as a single knit plain tricot. In example aspects, the material may include both polyester yarns and elastic yarns to achieve a desired degree of stretch and recovery while still providing a soft feel and good moisture management features. For example, the material may include about 60% polyester, including recycled polyester, and about 40% elastane. In at least some examples, the one or more additional layers of textile 2218 can include moisture-repellant properties, such as a durable water repellant (DWR) treatment. In at least some examples, the moisture-barrier layer 2208, the spacer textile 2210, and the additional textile layer(s) 2218 are bonded (e.g., laser bonded, adhesively bonded, or otherwise combined) together as a laminate.

Among other things, the combination of the moisture-barrier layer 2214, the spacer textile 2216, and the additional layer(s) 2218 can provide a textile that can be used to construct both internal assemblies (e.g., built-in briefs or built-in gussets), as well as external panels of an apparel article (e.g., by forming the external-layer crotch gusset in a lower-body garment). The laminate can, in some instances, improve manufacturability, based on only having a single composite textile as opposed to multiple discrete textile layers. In addition, the laminate can, in some cases be less insulative (e.g., as compared to a construction of multiple discrete layers that might trap heat in between the layers). In examples, the leak protection composite structure 2200C can be incorporated into any of the garments or articles of apparel described in this disclosure.

In examples, a leak protection composite structure (e.g., any of the leak protection composite structures 800, 1818, 2202A, 2202B, 2202C, or any other leak protection composite structure described in this disclosure) can be incorporated into a variety of different articles of apparel, such as articles of apparel that might include regions in which it is desirable to mask moisture (e.g., blood, urine, sweat, milk, etc.). For example, a leak protection composite structure can be incorporated into various lower-body garments, such as in various regions of the lower-body torso, including the crotch. In some examples, a leak protection composite structure can be incorporated into various upper-body garments, such as in breast-support portions of bras (e.g., nursing bras, pumping bras, sports bras, tank-style support garments) or other breast-supporting garments.

Referring to FIGS. 23A-23E, an example lower-body garment 2310 can include a leak protection composite structure 2312 (e.g., any of the leak protection composite structures 800, 1818, 2202A, 2202B, 2202C, or any other leak protection composite structure described in this disclosure). In examples, the leak protection composite structure 2312 is integrated directly into a gusset of the lower-body garment 2310. In some examples, the lower-body garment 2310 includes underwear configured to be worn beneath another lower-body garment (e.g., shorts, tights, pants, skirt, etc.). That is, the lower-body garment 2310 can include an undergarment configured to be selectively worn underneath a variety of external lower-body garments. In general, the lower-body garment 2310 includes a torso portion (e.g., front torso portion, back torso portion, right side torso portion or right hip, and left side torso portion or left hip) with leg openings (e.g., right leg opening and left leg opening).

The style depicted in FIGS. 23A-23E is an example, and in other instances the style of underwear can include boyshort, thong, etc. In some examples, the lower-body garment 2310 includes a portion of a swimsuit. In some examples, the lower-body garment 2310 is configured to be worn for athletic or fitness activities (e.g., track-and-field, distance running, triathlons, duathlons, volleyball, etc.). In some examples, the leak protection composite structure 2312 can comprise at least most of the underwear garment (e.g., areas in addition to just the crotch area, such as the torso front portion and/or the torso back portion). In some examples, the lower-body garment 2310 can be coupled (e.g., as an internal assembly) to the interior of a lower-body garment (e.g., shorts, tights, pants, skirt, etc.) to provide built-in underwear.

In some examples, the leak protection composite structure 2312 is positioned in select areas (e.g., in the crotch area), similar to the construction associated with 1810*a* and 1810*b*. In addition, similar to the construction associated with 1810*a* and 1810*b*, the lower-body garment 2310 can include an outer layer that is similar to the layer 1816 and that is coupled to the leak protection composite structure 2312 similar to the constructions shown in FIG. 19 and/or FIG. 20. For example, the outer layer of the lower-body garment 2310 can include side edges that wrap around the sides of the leak protection composite structure (e.g., similar to the structure depicted in FIG. 20) and are secured to the leak protection composite structure (e.g., via bonding). In some examples, the front and/or back edges of the leak protection composite structure 2312 can be coupled to the outer layer via seam tape (e.g., similar to the tape 1910).

In examples, a panel comprising a leak protection composite structure for lower-body garments can include various shapes and sizes. The figures described above include various examples, which are non-limiting. For example, in some instances, a rear top edge of the leak protection composite structure can extend at least up to a yoke seam, and in some examples to a waistband. In some examples, a rear top edge that extends further up on the lower-body garment can provide more coverage, as compared to a structure with a rear top edge that terminates lower on the garment.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A lower-body garment comprising:

an external layer forming an exterior torso portion, the exterior torso portion having a waist opening, a first leg portion including a first leg opening, and a second leg portion including a second leg opening;

an internal assembly positioned internal to the external layer, the internal assembly comprising:

an interior front torso portion comprising a front upper edge secured to the external layer a first distance away from the waist opening;

an interior back torso portion comprising a back upper edge secured to the external layer a second distance away from the waist opening, wherein the second distance is greater than the first distance; and a crotch panel between the interior front torso portion and the interior back torso portion, and positioned between the first leg opening and the second leg opening of the exterior torso portion, the crotch panel comprising a spacer fabric layer and a moisture-barrier layer secured to the spacer fabric layer.

2. The lower-body garment of claim 1, wherein the interior front torso portion of the internal assembly includes a front upper edge secured to the external layer, and wherein the interior back torso portion of the internal assembly includes a back upper edge secured to the external layer.

3. The lower-body garment of claim 1, wherein: the interior front torso portion has a first side edge that is located on a first side of the lower-body garment and that includes a first lower end positioned a third distance below the waist opening, and the interior back torso portion has a first back side edge that is located on the first side of the lower-body garment and that includes a second lower end positioned a fourth distance below the waist opening, the second distance being greater than the first distance.

4. The lower-body garment of claim 1, wherein the internal assembly further comprises a crotch area that continuously extends between the interior front torso portion and the interior back torso portion and that includes an inner-facing surface facing towards the crotch panel.

5. The lower-body garment of claim 1, wherein:

the interior front torso portion has a first front side edge located on a first side of the lower-body garment, the interior back torso portion has a first back side edge that is located on the first side of the lower-body garment, and the first front side edge of the interior front torso portion is spaced apart from the first back side edge of the interior back torso portion.

6. The lower-body garment of claim 5, wherein the crotch panel joins the interior front torso portion to the interior back torso portion.

7. The lower-body garment of claim 1, wherein the interior front torso portion and the interior back torso portion form a built-in undergarment and comprise a durable water repellant (DWR) treatment.

8. The lower-body garment of claim 1, wherein the internal assembly further comprises a crotch area that continuously extends between the interior front torso portion and the interior back torso portion and that wraps around side edges of the crotch panel.

9. The lower-body garment of claim 1, wherein the spacer fabric layer comprises an innermost surface of the lower-body garment and comprises a first layer, a second layer, and a plurality of tie yarns that interconnect the first layer and the second layer, the plurality of tie yarns comprising elastic yarns.

10. The lower-body garment of claim 1, wherein the moisture-barrier layer comprises a thermoplastic polymer material.

11. The lower-body garment of claim 1, wherein:

the interior front torso portion has a first front side edge located on a first side of the lower-body garment, the interior back torso portion has a first back side edge that is located on the first side of the lower-body garment, and the first front side edge of the interior front torso portion is affixed to the first back side edge of the interior back torso portion.

12. A lower-body garment comprising: a torso portion comprising a first leg opening and a second leg opening; and a crotch portion between the first leg opening and the second leg opening, wherein the crotch portion of the lower-body garment comprises a textile layer comprising a durable water repellant (DWR) treatment on an inner facing surface of the textile layer and a composite textile, wherein the composite textile comprises a spacer fabric and a moisture-barrier layer, and wherein the moisture-barrier layer comprises a thermoplastic polymer film, wherein at least a portion of the moisture-barrier layer is layered between the spacer fabric and the textile layer, wherein when the lower-body garment is in an as-worn configuration, the spacer fabric is positioned adjacent to a skin surface of a wearer, wherein the spacer fabric comprises a side edge proximate the first leg opening; and wherein material from the textile layer of the crotch portion wraps over the side edge of the spacer fabric to form a hem.

13. The lower-body garment of claim 12, wherein the spacer fabric comprises a front edge coupled to a front of the torso portion; and wherein the lower-body garment further comprises a DWR-treated bonding strip that at least partially overlaps the front edge and the front of the torso portion.

14. The lower-body garment of claim 13, wherein the DWR-treated bonding strip comprises an adhesive layer.

15. The lower-body garment of claim 12, wherein the spacer fabric comprises a spacer knit textile comprising a first knit layer, a second knit layer, and tie yarns connecting the first knit layer to the second knit layer.

16. The lower-body garment of claim 15, wherein the tie yarns comprise a first yarn having a first denier and a second yarn having a second denier, which is different from the first denier.

17. The lower-body garment of claim 12, wherein:

the torso portion comprises a front upper edge and a back upper edge, at least one of the front upper edge and the back upper edge being affixed to an external garment layer.

18. The lower-body garment of claim 12, wherein lower-body garment comprises an undergarment configured to be selectively worn underneath a variety of external lower-body garments.

19. The lower-body garment of claim 12, wherein when the lower-body garment is in an as-worn configuration, the spacer fabric is positioned adjacent to a skin surface of a wearer, and wherein the spacer fabric comprises an edge secured to the textile layer with a bonding strip.

20. The lower-body garment of claim 19, wherein the bonding strip comprises an outer textile layer treated with DWR.

21. A lower-body garment comprising: a torso portion comprising a first leg opening and a second leg opening; and a crotch portion between a first leg opening and a second leg opening, wherein the crotch portion of the lower-body garment comprises a textile layer comprising a durable water repellant (DWR) treatment on an inner facing surface of the textile layer and a composite textile; the composite textile comprising: a spacer fabric layer, and a moisture-barrier layer secured to the spacer fabric layer, wherein at least a portion of the moisture-barrier layer is layered between the spacer fabric layer and the textile layer, wherein when the lower-body garment is in an as-worn configuration, the spacer fabric layer is positioned adjacent to a skin surface of a wearer, wherein the spacer fabric layer comprises a side edge proximate the first leg opening; and wherein material from the textile layer of the crotch portion wraps over the side edge of the spacer fabric layer to form a hem.

22. The lower-body garment of claim 21, wherein the moisture-barrier layer is layered between the textile layer and the spacer fabric layer, and wherein material of the textile layer envelops a side edge of the composite textile.

23. The lower-body garment of claim 22, wherein the textile layer further comprises the durable water repellant (DWR) treatment on an outer facing surface of the textile layer.

24. The lower-body garment of claim 23, wherein the spacer fabric layer, the moisture-barrier layer, and the textile layer comprise an integral crotch gusset associated with the lower-body garment.

25. The lower-body garment of claim 24, wherein the lower-body garment is an undergarment.

26. The lower-body garment of claim 23, wherein the spacer fabric layer, the moisture-barrier layer, and the textile layer comprise a crotch area of a built-in undergarment that is affixed in an interior of the lower-body garment.

27. The lower-body garment of claim 23, wherein the composite textile has a front edge and a back edge, the lower-body garment further comprising a first bonding strip coupling the front edge to the torso portion and a second bonding strip coupling the back edge to the torso portion.

28. The lower-body garment of claim 23, wherein the textile layer is laminated together with the spacer fabric layer and the moisture-barrier layer.

* * * * *